US011713224B2

(12) United States Patent
Jubeck et al.

(10) Patent No.: US 11,713,224 B2
(45) Date of Patent: Aug. 1, 2023

(54) HIGH CAPACITY CABLE PULLER WITH MULTI-SPEED AUTOMATIC SHIFTING TRANSMISSION

(71) Applicant: GREENLEE TOOLS, INC., Rockford, IL (US)

(72) Inventors: John Michael Jubeck, Rockford, IL (US); Mateusz Lukasz Wielgos, Cherry Valley, IL (US)

(73) Assignee: GREENLEE TOOLS, INC., Rockford, IL (US)

( * ) Notice: Subject to any disclaimer, the term of this patent is extended or adjusted under 35 U.S.C. 154(b) by 233 days.

(21) Appl. No.: 17/323,044

(22) Filed: May 18, 2021

(65) Prior Publication Data

US 2021/0362988 A1 Nov. 25, 2021

Related U.S. Application Data

(60) Provisional application No. 63/026,839, filed on May 19, 2020.

(51) Int. Cl.
*B66D 1/74* (2006.01)

(52) U.S. Cl.
CPC ..... *B66D 1/7484* (2013.01); *B66D 1/7447* (2013.01)

(58) Field of Classification Search
CPC ..... B66D 1/14; B66D 1/24; B66D 1/7447; B66D 1/7484; B66D 3/22
See application file for complete search history.

(56) References Cited

U.S. PATENT DOCUMENTS 4,054,266 A 10/1977 Guangorena
4,149,115 A * 4/1979 Noly ..... B66D 1/12 310/95
4,565,352 A 1/1986 Hasselmann et al.
4,667,933 A 5/1987 Frommherz
4,974,814 A * 12/1990 Cundy ..... B66D 1/24 254/342

(Continued)

FOREIGN PATENT DOCUMENTS

CN 2802203 Y 8/2006
CN 102518759 A 6/2012

(Continued)

OTHER PUBLICATIONS

International Search Report for International Patent Application No. PCT/US21/32863, dated Sep. 23, 2021, 5 pages.

(Continued)

*Primary Examiner* — Sang K Kim
*Assistant Examiner* — Nathaniel L Adams
(74) *Attorney, Agent, or Firm* — Klintworth & Rozenblat IP LLP

(57) ABSTRACT

A cable puller is provided to pull rope or cable where the cable puller includes a puller frame, a capstan rotatably mounted on the puller frame around a first axis of rotation, an output shaft rotatably mounted to the puller frame and coupled to the capstan, The capstan is configured to rotate when the output shaft is driven. A shift motor is configured to drive a cam to engage gearing coupled to the output shaft to a gear position comprising a low speed position, a medium speed position, and a high-speed position.

16 Claims, 16 Drawing Sheets

(56) References Cited

U.S. PATENT DOCUMENTS

| | | | | |
|---|---|---|---|---|
| 7,513,485 | B2 * | 4/2009 | Lee | B66D 1/48 254/350 |
| 8,246,009 | B2 | 8/2012 | Plummer | |
| 8,302,936 | B2 | 11/2012 | Plummer | |
| 2018/0191141 | A1 | 7/2018 | Schmidt et al. | |

FOREIGN PATENT DOCUMENTS

| | | | | | |
|---|---|---|---|---|---|
| CN | 204138232 | U | | 2/2015 | |
| DE | 361151 | C | * | 10/1922 | B66D 1/24 |
| DE | 1190628 | B | * | 12/1965 | B66D 1/24 |
| GB | 191226279 | A | * | 11/1913 | B66D 1/08 |
| KR | 1412967 | B1 | * | 6/2014 | B66D 1/24 |

OTHER PUBLICATIONS

Written Opinion for International Patent Application No. PCT/US21/32863, dated Sep. 23, 2021, 7 pages.
English machine translation of CN2802203Y.
English machine translation of CN102518759A.
English machine translation of CN204138232U.
"What are Overrunning Clutches?" Motion Control Tips, https://www.motioncontroltips.com/what-are-overrunning-clutches/, WTWH Media LLC, 2020, 9 pages.
Instruction Manual, "UT10 Ultra Tugger® Cable Puller and Pulling Packages—Serial Codes ANB and BBD," Greenlee Textron Inc., Rockford, IL, 2016, 116 pages.

* cited by examiner

HIGH CAPACITY CABLE PULLER WITH MULTI-SPEED AUTOMATIC SHIFTING TRANSMISSION

CROSS-REFERENCE TO RELATED APPLICATION(S)

This application claims priority to U.S. provisional application Ser. No. 63/026,839, filed on May 19, 2020, the contents of which are incorporated herein in its entirety.

FIELD OF THE DISCLOSURE

The present disclosure relates to a high capacity cable puller having multi-speed automatic shifting transmission.

BACKGROUND

Cable pulling is a commonly used technique in building, whereby a pulling rope is attached to a cable or wire that is to be pulled through conduit or along a cable tray by the cable puller. The conduit or cable tray may be any length and may contain any number of bends, turns, or other layout characteristics. The pulling rope is wound by a user around a capstan on the cable puller and tails off the capstan. The capstan is powered by a motor and acts as a frictional force multiplier. The capstan and motor are usually referred to as being part of the puller head of the cable puller. Use of the cable puller to pull the cable or wire through the conduit or along the cable tray allows the user to exert only a small force on the pulling rope that tails off the capstan. This relatively small force is translated into a large force of several thousand pounds which is exerted on the incoming pulling rope and which provides enough force on the pulling rope and the cable or wire to pull them through the conduit or along the cable tray. A cable puller can be used in any application in which a force multiplication is needed for lifting or pulling an item also be used to pull or lift materials, such as material handling on a construction site, winching, and logging.

Some prior art cable pullers require the operator to completely stop the cable pull to change the speed of the cable puller. The operator may have to stop the motor, unwrap the rope from the capstan thereby releasing the load in the system, wrap the rope around a second capstan, and then power the motor back on to resume the pull at a new speed. Other prior art cable pullers require that the operator stop the motor, and either tie off the rope to hold the load on the capstan or unwrap the rope to release the load in the pull, and manually flip a selector switch on the equipped gear-motor to the preferred speed selection, and then "feather" power to the motor while holding the selector switch in place until the selected gear moves into mesh. Another prior art solution uses a motor that operates both clockwise and counterclockwise, and a 2-speed offset gear reduction with an idler gear to allow one speed when the motor runs clockwise and another speed when the motor runs counterclockwise. When the operator initializes a speed change, the motor of the cable puller must come to a complete stop (velocity of the pull rope goes to zero) and then the motor reverses direction and ramps up to resume the pull at the newly selected speed.

SUMMARY

In an aspect of the invention, a cable puller is provided to pull rope or cable where the cable puller includes a puller frame, a capstan rotatably mounted on the puller frame around a first axis of rotation, an output shaft rotatably mounted to the puller frame and coupled to the capstan. The capstan is configured to rotate when the output shaft is driven. A shift motor is configured to drive a cam to engage gearing coupled to the output shaft to a gear position comprising a low speed position, a medium speed position, and a high-speed position.

A drive motor is configured to rotate the output shaft via gearing comprising a low speed gear set, a medium speed gear set, and a high-speed gear set. The drive motor rotates the output shaft to drive the low speed gear set when the shift motor positions the cam to the low speed position, to drive the medium speed gear set when the shift motor positions the cam to the medium speed position, and to drive the high-speed gear set when the shift motor positions the cam to the high-speed position. A user switch is configured to switch the drive motor to an ON state to turn the output shaft.

A control system is provided and includes a motor controller having a processor and controller logic comprising machine-executable instructions configured to be executed by the processor in an automatic mode. The controller logic may be configured to: drive the drive motor when the user switch is actuated to switch the drive motor to the ON state at a speed less than a maximum speed; repeatedly detect the motor speed and the power level of power consumed by the drive motor; drive the drive motor at a decreasing speed when the power level becomes greater than a maximum power level; drive the drive motor at a reduced speed and drive the shift motor to a current gear position plus one level when the power level is less than or equal to a power upshift level, the motor speed is at the maximum speed, and the current gear position is not the high-speed position; and drive the drive motor at a reduced speed and drive the shift motor to a current gear position minus one level when the power level is greater than or equal to a power downshift level, the motor speed is less than or equal to a downshift speed, and the current gear position is not the low speed position.

In another aspect, the control system may include a manual mode configured to enable the user to control the gear position of the shift motor.

BRIEF DESCRIPTION OF THE FIGURES

FIG. 5 depicts a perspective view of an output shaft of the cable puller;

DETAILED DESCRIPTION

Figure 1:
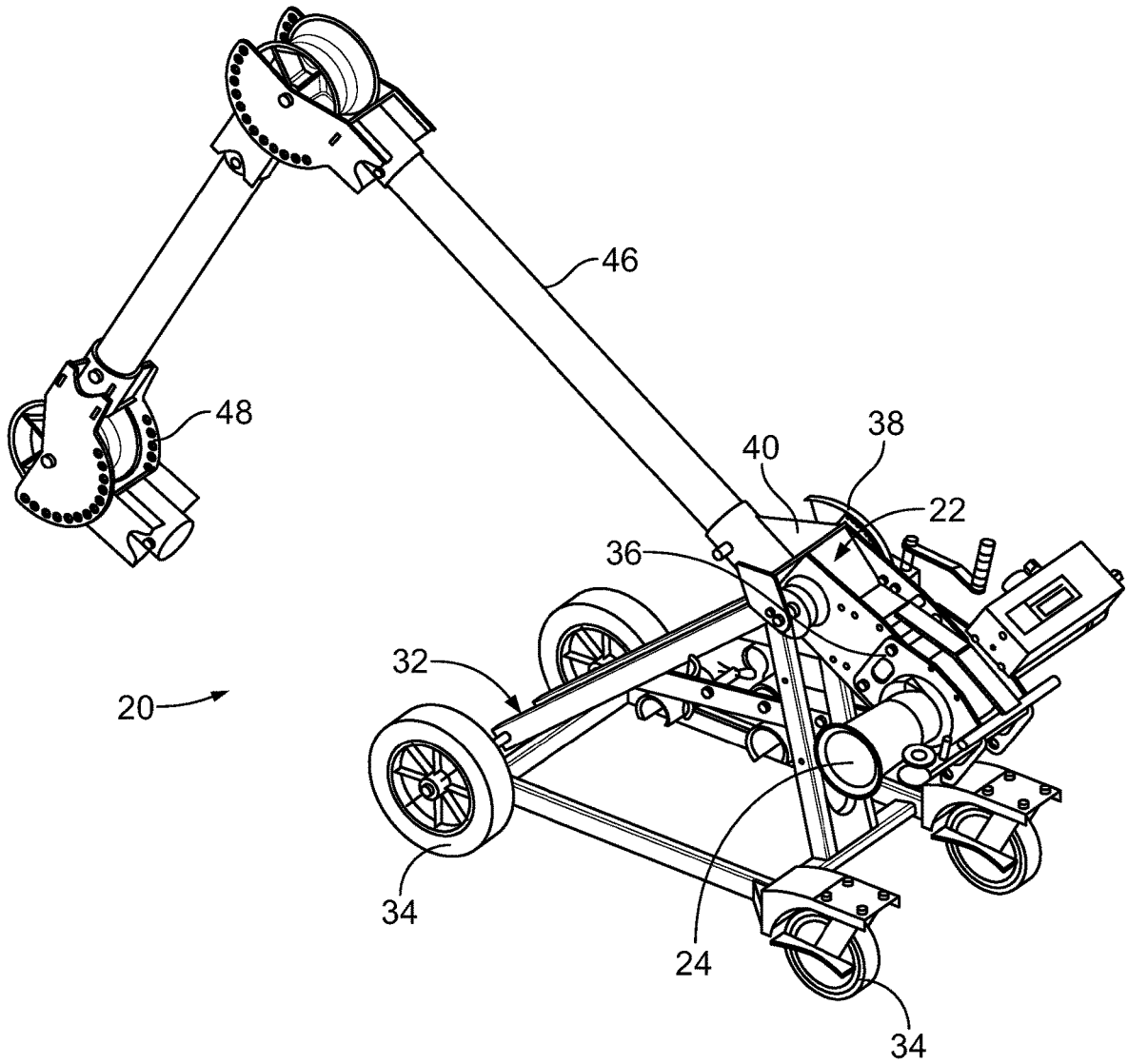
FIG. 1 depicts a perspective view of an example cable puller which incorporates features of the present disclosure.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

A multi speed transmission cable puller 20 is provided to pull a pulling rope and/or cable (not shown) attached to a cable or wire through conduit or a cable tray (not shown). An operator can switch between speeds without requiring the capstan of the cable puller 20 to come to a complete stop. This allows the operator to maintain control of the load being pulled throughout the duration of the cable pull by the cable puller 20.

Figure 2:
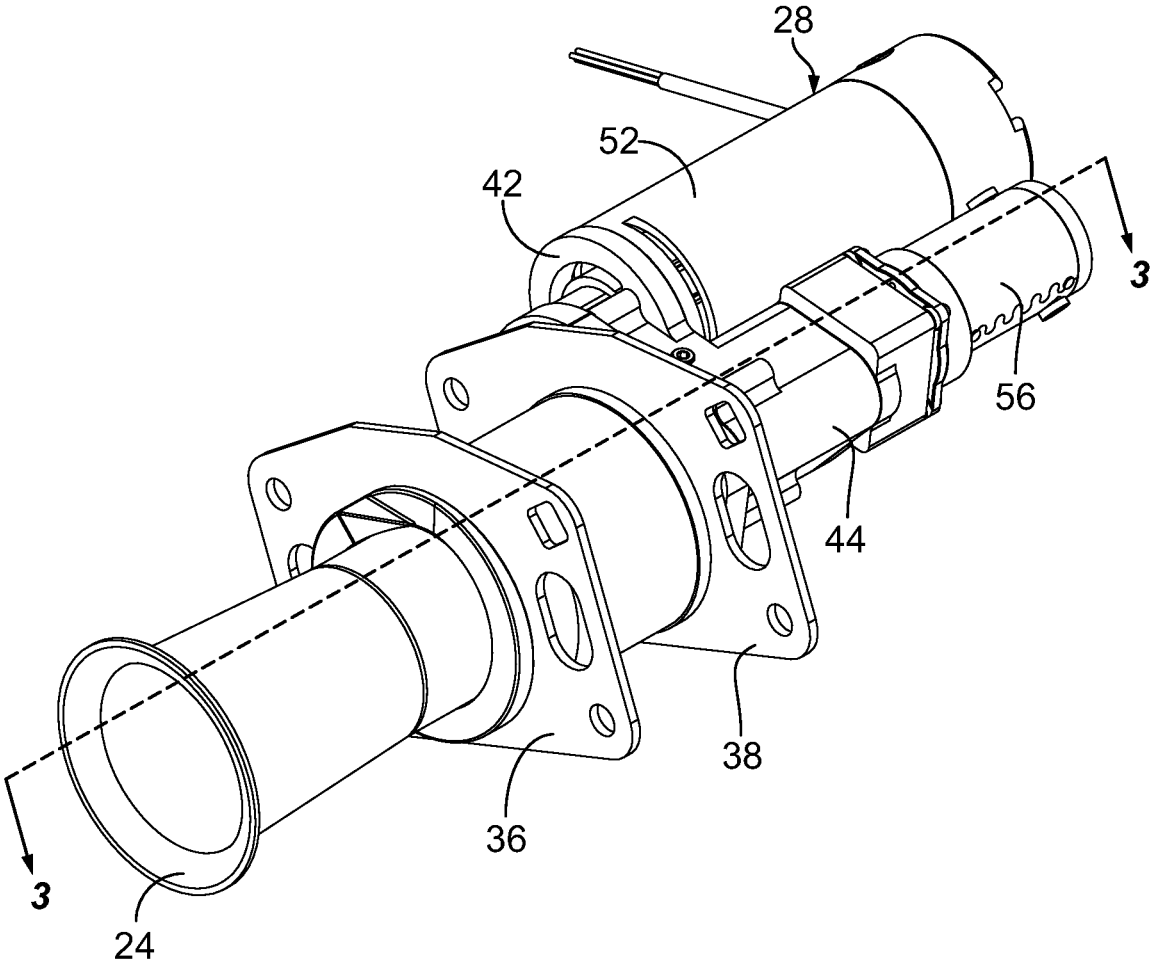
FIG. 2 depicts a perspective view of capstan and driving assemblies of the cable puller.
Figure 3:
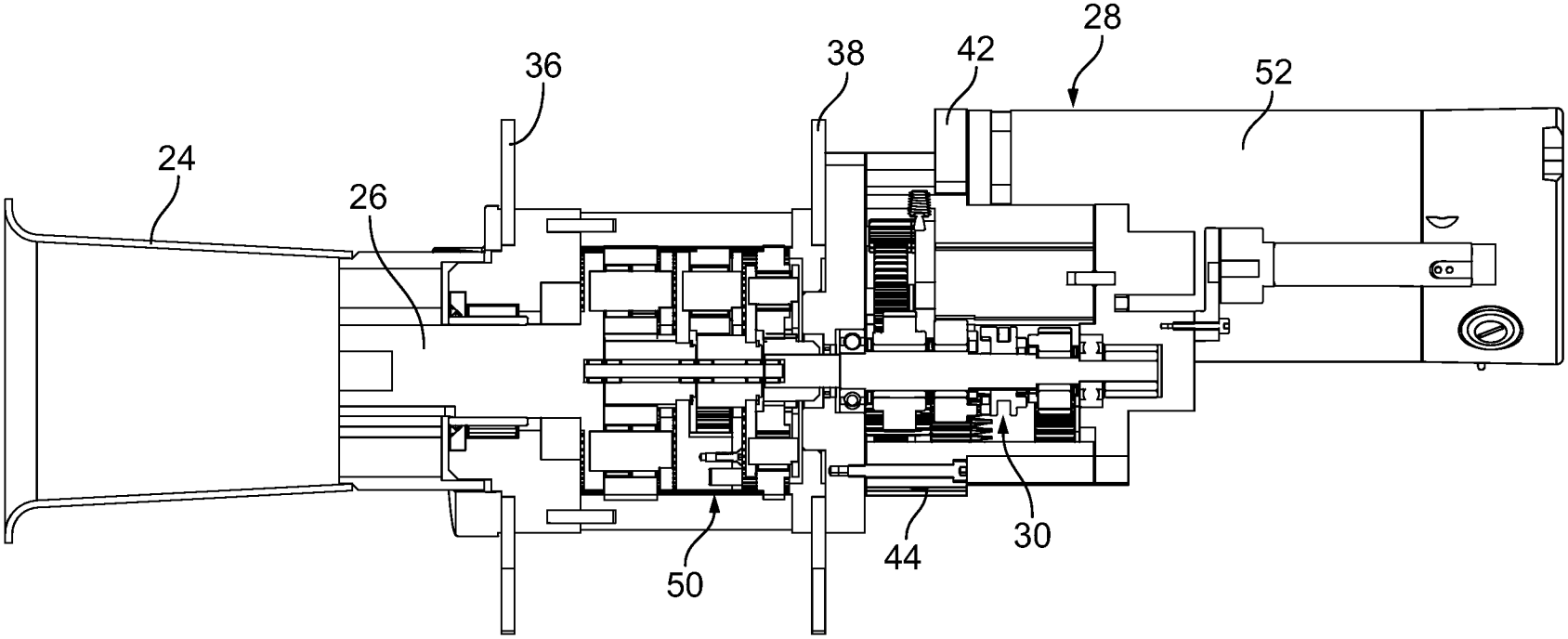
FIG. 3 depicts a cross-sectional view along line 3-3 of FIG. 2.

As shown in FIGS. 1-3, a cable puller 20 includes a puller frame 22, a capstan 24 rotatably mounted on a capstan shaft 26 which extends from the puller frame 22, and a driving assembly 28 for driving the capstan 24. The driving assembly 28 includes a multi-speed automatic shifting transmission 30. In an embodiment, the puller frame 22 is mounted on the floor or ground. In an example embodiment and as shown, the puller frame 22 is mounted on a cart 32. The cart 32 may have lockable wheels 34. The puller frame 22 has a first upright wall 36, a second upright wall 38, walls 40 extending between the upright walls 36, 38 to form a first cavity, a third upright wall 42, and walls 44 extending between the upright walls 38, 42 to form a second cavity.

The capstan 24 has a generally cylindrical outer surface around which the pulling rope and/or cable is wound as is known in the art. A non-limiting example of a suitable capstan 24 is shown in U.S. Pat. No. 8,302,936. The capstan shaft 26 defines a rotational axis which is substantially parallel to the underlying floor or ground upon which the cable puller 20 rests.

A boom 46 may be removably attached to the puller frame 22 and extends from the puller frame 22 as is known in the art. A free end of the boom 46 may have an attachment system 48 attached thereto which is configured to rigidly secure the cable puller 20 to the conduit or cable tray from which the pulling rope and/or cable are to be pulled. A non-limiting example of a suitable attachment system 48 is shown in U.S. Pat. No. 8,246,009. In use, a free end of the boom 46 is positioned adjacent an end of the conduit or cable tray through which a length of pulling rope and/or cable is desired to be pulled. A segment of the length of the pulling rope and/or cable is routed over the attachment system 48, if provided, over the free end of the boom 46, along the length of the boom 46 and is wrapped about the capstan 24. Upon rotation of the capstan 24 by the driving assembly 28, the length of pulling rope and/or cable is pulled through the conduit or cable tray and toward the capstan 24.

Figure 4:
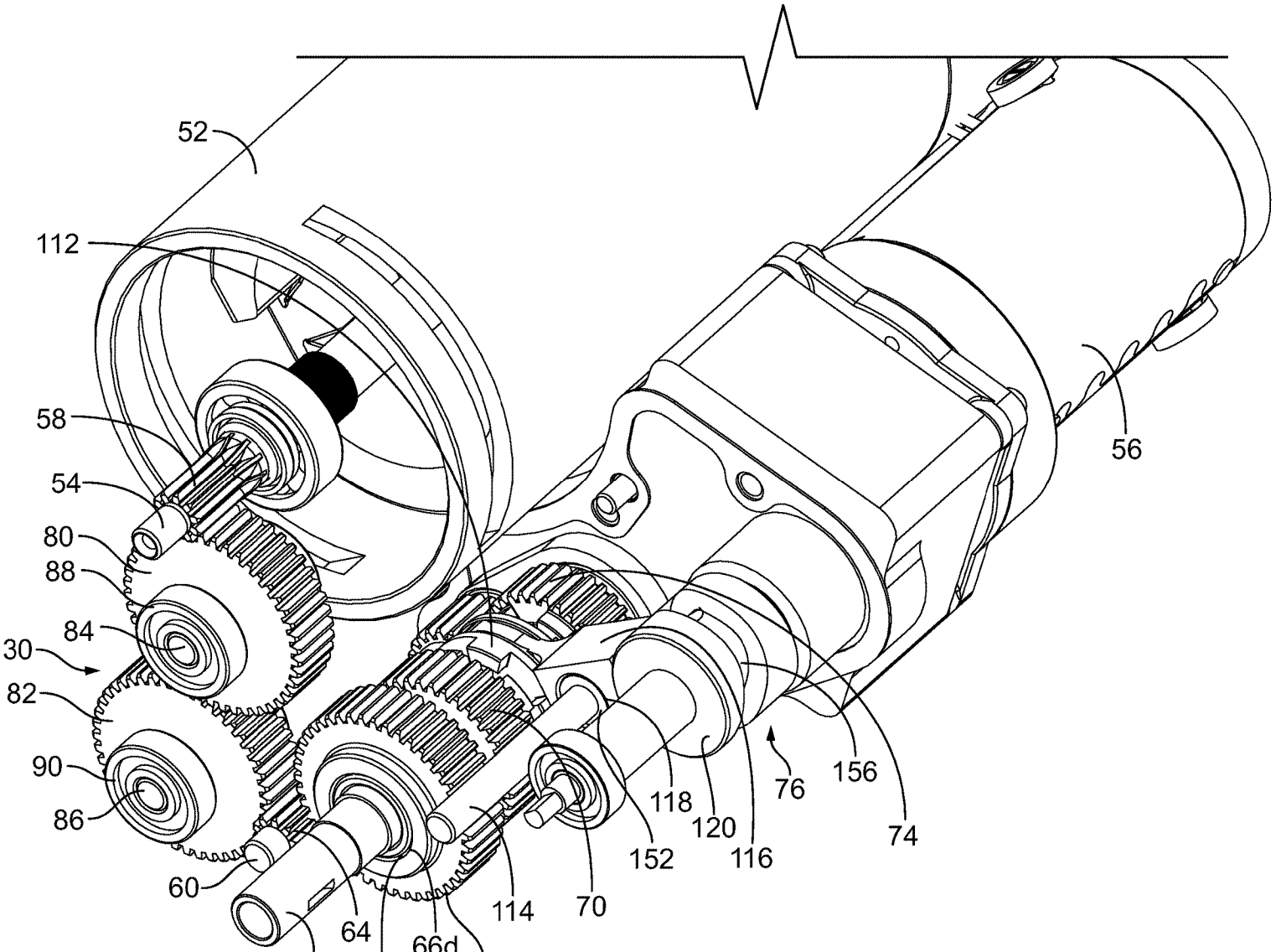
FIG. 4 depicts a perspective view of a transmission and motors of the cable puller.
Figure 5:
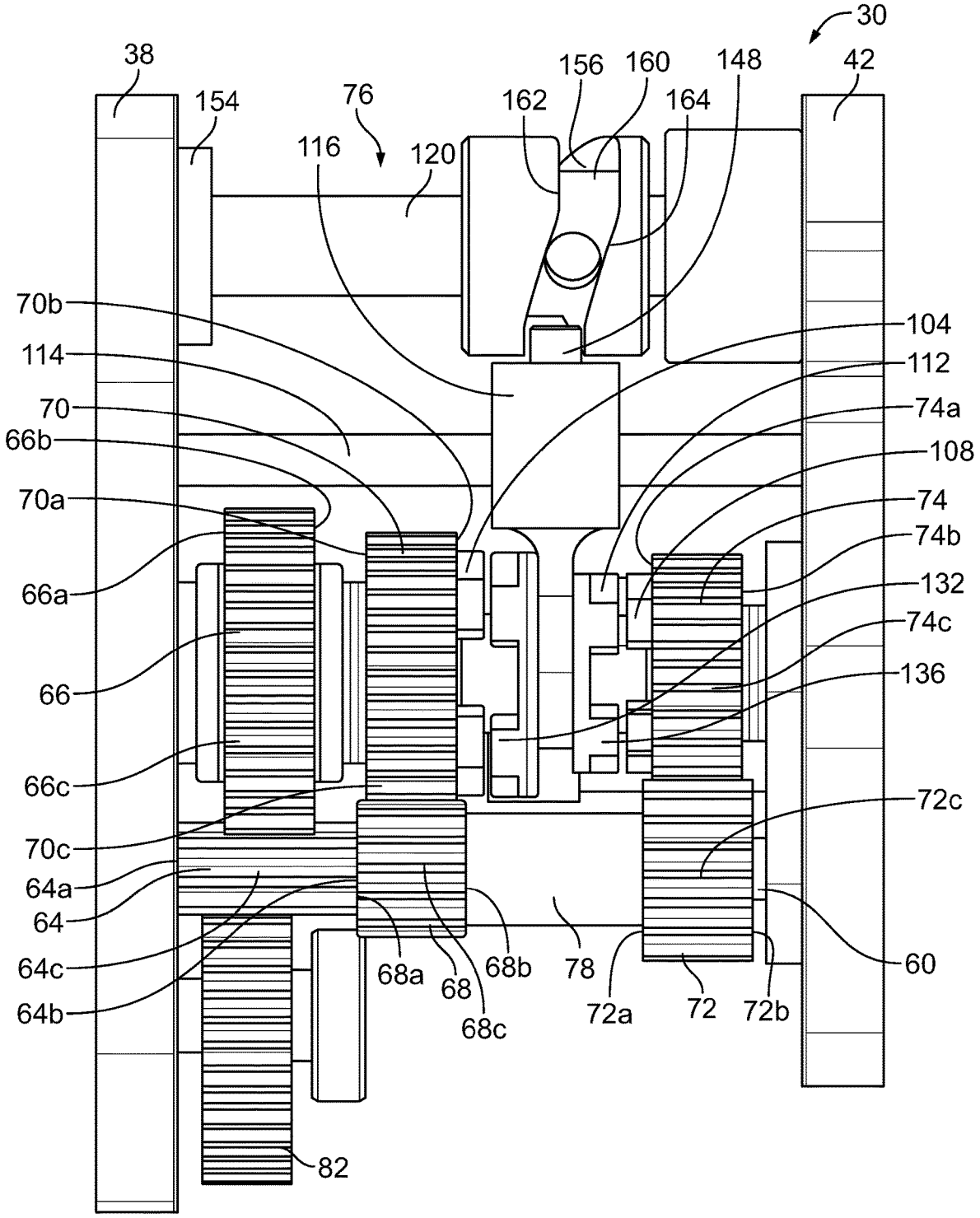
FIG. 5 depicts a perspective view of a transmission of the cable puller.

The driving assembly 28 includes the multi-speed automatic shifting transmission 30 which is generally with the second cavity, a gearing arrangement 50 mounted within a gear housing in the first cavity and which is coupled to the capstan shaft 26 and is coupled to the transmission 30, a main driver or motor 52 having a main motor output shaft 54, see FIG. 4, extending therefrom and which is connected to the transmission 30, and a shift driver or motor 56 having an output shaft extending therefrom and which is connected to the transmission 30. The gearing arrangement 50 may be planetary gear set, but may take other forms. The capstan shaft 26 extends through the wall 36 of the puller frame 22 for connection to the gearing arrangement 50. The main motor output shaft 54 and the output shaft of the shift motor 56 extend into the second cavity for connection with the transmission 30. The main motor output shaft 54 has a splined end 58 for connection with the transmission 30.

In some embodiments, the main motor 52 is a servomotor or stepper motor. In some embodiments, the main motor 52 is a gear motor, a brushless DC servo motor, a Permanent Magnet DC (PMDC) motor an AC induction motor with modulated control signal and switches to control speed and direction of rotation, some combination thereof, or the like. In some embodiments, the main motor 52 is an internal combustion engine. In some embodiments, the main motor 52 is a drill. The main motor 52 may include an on-board motor controller, which may control operation of the main motor 52, and which may form part of and/or interface with a motor control apparatus 200 illustrated in and described with respect to FIG. 21. The main motor 52 may be indirectly interfaced via and controlled by control circuitry, such as may be provided by the control apparatus 200.

In some embodiments, the shift motor 56 is a servomotor or stepper motor. In some embodiments, the shift motor 56 is a gear motor, a brushless DC servo motor, a Permanent Magnet DC (PMDC) motor an AC induction motor with modulated control signal and switches to control speed and direction of rotation, some combination thereof, or the like. In some embodiments, the shift motor 56 is a rotary solenoid. In some embodiments, the shift motor 56 may include an on-board motor controller, which may control operation of the shift motor 56, and which may form part of and/or interface with the control apparatus 200 illustrated in and described with respect to FIG. 21. The shift motor 56 may be indirectly interfaced via and controlled by control circuitry, such as may be provided by the control apparatus 200.

The transmission 30 is provided in the second cavity and is used for changing the speed of rotation of the capstan 24. As shown, the transmission 30 can be used to provide three speeds of rotation for the capstan 24 during use. The speed of the cable puller 20 can be changed without stopping the cable puller 20 during a pull. The transmission 30 includes a pinion gear shaft 60, an output shaft 62, a low speed pinion gear 64, a low speed driven gear 66, a medium speed pinion gear 68, a medium speed driven gear 70, a high-speed pinion gear 72, a high-speed driven gear 74, and a shifting assembly 76. The transmission 30 interacts with the main motor 52, the shift motor 56 and the gearing arrangement 50 as described herein to rotate the capstan 24.

The pinion gear shaft 60 has ends which are coupled by bearings (not shown) to the walls 38, 42 such that the pinion gear shaft 60 can rotate within the second cavity. The pinion gears 64, 68, 72 are rotationally fixed on the pinion gear shaft 60. The pinion gears 64, 68, 72 may be integrally formed with the pinion gear shaft 60, or one or more of the pinion gears 64, 68, 72 may be separately formed from the pinion gear shaft 60 and thereafter non-rotatably affixed to the pinion gear shaft 60.

Each pinion gear 64, 68, 72 has a cylindrical body having a first face 64*a*, 68*a*, 72*a* and an opposite second face 64*b*, 68*b*, 72*b*, and a plurality of teeth 64*c*, 68*c*, 72*c* on its exterior surface. The low speed pinion gear 64 has a diameter which is larger than the medium speed pinion gear 68, and the medium speed pinion gear 68 has a diameter which is larger than the high-speed pinion gear 72. As shown, the low speed pinion gear 64 is proximate to the wall 38; the medium speed pinion gear 68 is proximate to the low speed pinion gear 64; the high-speed pinion gear 72 is proximate to the wall 42 and spaced from the medium speed pinion gear 68 by a spacer 78 mounted on the pinion gear shaft 60.

The low speed pinion gear 64 is coupled to the splined end 58 of the main motor output shaft 54 such that when the main motor output shaft 54 is rotated, the low speed pinion gear 64 rotates which, in turn, causes rotation of the pinion gear shaft 60, the medium speed pinion gear 68 and the high-speed pinion gear 72. In an embodiment, the low speed pinion gear 64 is coupled to the main motor output shaft 54 by a plurality of idler rollers 80, 82. The idler rollers 80, 82 are mounted on shafts 84, 86 which are coupled to the wall 40 by bearings 88, 90.

Figure 6:
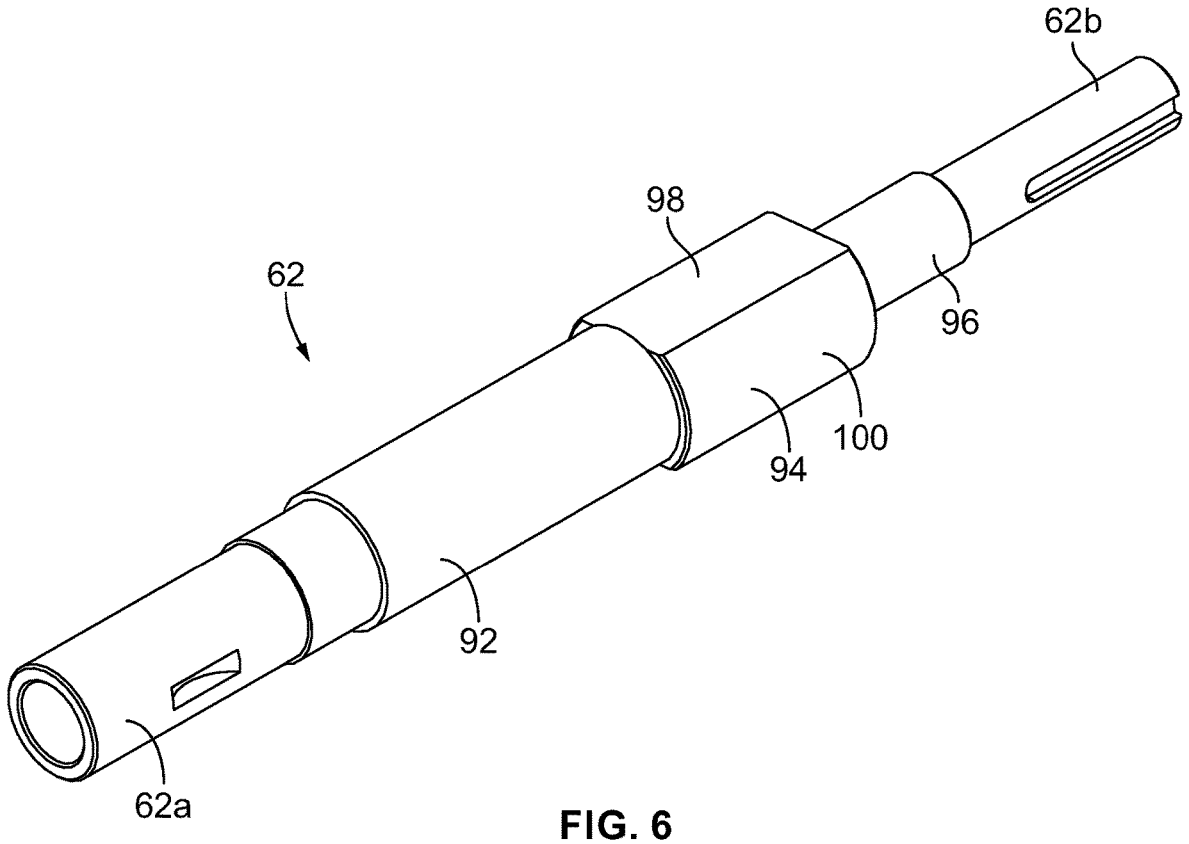
FIG. 6 depicts a perspective view of an output shaft of the transmission.

The output shaft 62 has an end 62*a* that passes through a bearing (not shown) in the wall 38 and is coupled to the gearing arrangement 50, and an opposite end 62*b* which is coupled by a bearing (not shown) to the wall 42. A centerline of the pinion gear shaft 60 and the output shaft 62 are parallel to each other. In an embodiment, a centerline of the main motor output shaft 54 is also parallel to the centerlines of the pinion gear shaft 60 and the output shaft 62. As best shown in FIG. 6, the output shaft 62 has a first cylindrical section 92, a second, intermediate section 94 having a non-cylindrical configuration thereon extending from an end of the first section 92, and a third, cylindrical section 96 extending from an end of the intermediate section 94. In an embodiment, the intermediate section 94 has a double-D configuration thereon having an opposing pair of flat surfaces 98 and an opposing pair of curved surfaces 100; other non-cylindrical configurations such as a hexagon, etc. are within the scope of the present disclosure. When the output shaft 62 is driven as described herein, the gearing arrangement 50 is rotated, and as a result, the capstan 24 is rotated.

The low speed driven gear 66 has a cylindrical body having a first face 66*a* and an opposite second face 66*b*, a plurality of teeth 66*c* on its exterior surface, and a passageway 66*d* extending therethrough and between the faces 66*a*, 66*b*. The low speed driven gear 66 is mounted on the first section 92 of the output shaft 62 by an overrunning clutch 102, see FIG. 4, which is mounted in the passageway 66*d*. The teeth 66*c* of the low speed driven gear 66 always intermesh with the teeth 64*c* on the low speed pinion gear 64. Such an overrunning clutch 102 may be a sprag clutch, a roller ramp clutch, a wrap spring clutch, or a wedge clutch. When the output shaft 62 is driven by the low speed driven gear 66 as described herein, the output shaft 62 is driven at a low speed in a first direction.

Figure 7:
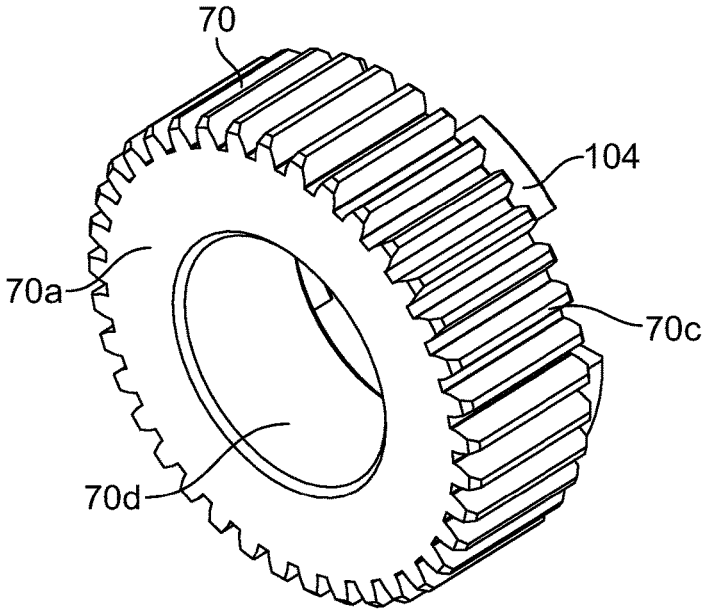
FIG. 7 depicts a perspective view of a medium speed driven gear of the transmission.
Figure 8:
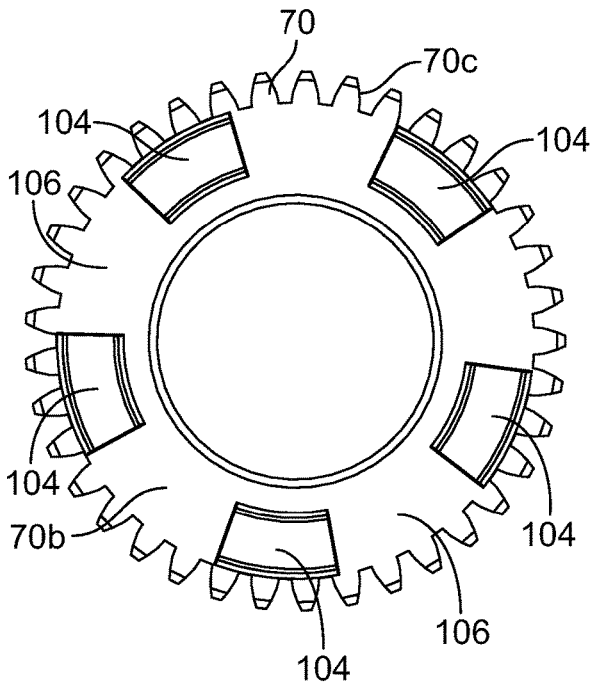
FIG. 8 depicts an end elevation view of the medium speed driven gear.

As best shown in FIGS. 7 and 8, the medium speed driven gear 70 has a cylindrical body having a first face 70*a* and an opposite second face 70*b*, a plurality of teeth 70*c* on its exterior surface, and a passageway 70*d* extending therethrough and between the faces 70*a*, 70*b*. The second face 70*b* of the medium speed driven gear 70 is planar with the exception of a plurality of spaced apart cogs 104 which extend outward therefrom such that spaces 106 are formed between adjacent cogs 104. The medium speed driven gear 70 is mounted on the first section 92 of the output shaft 62 by a bearing (not shown) mounted in the passageway 70*d*. The face 70*a* of the medium speed driven gear 70 is proximate to the face 66*b* of the low speed driven gear 66. The cogs 104 extend in the direction of the intermediate section 94 of the output shaft 62 and may overlap the intermediate section 94. The teeth 70*c* of the medium speed driven gear 70 always intermesh with the teeth 68*c* of the medium speed pinion gear 68. When the output shaft 62 is driven by the medium speed driven gear 70 as described herein, the output shaft 62 is driven at a medium speed which is faster than the low speed.

Figure 9:
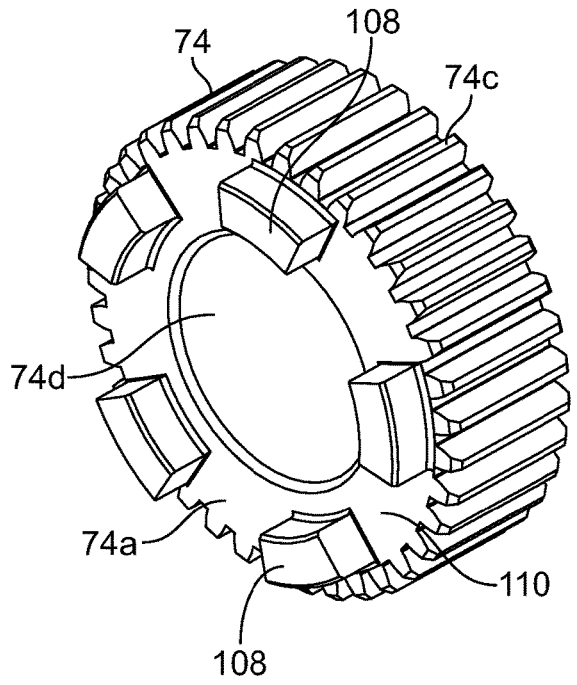
FIG. 9 depicts a perspective view of a high-speed driven gear of the transmission.
Figure 10:
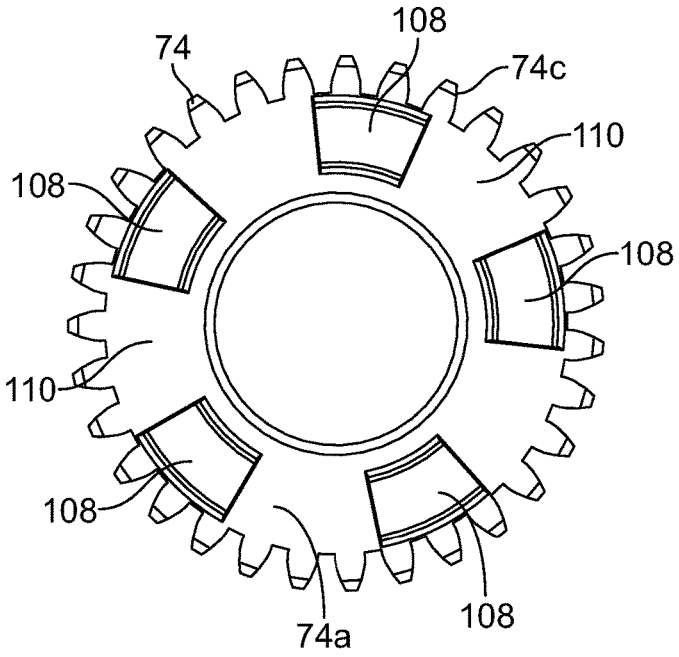
FIG. 10 depicts an end elevation view of the high-speed driven gear.

As best shown in FIGS. 9 and 10, the high-speed driven gear 74 has a cylindrical body having a first face 74*a* and an opposite second face 74*b*, a plurality of teeth 74*c* on its exterior surface, and a passageway 74*d* extending therethrough and between the faces 74*a*, 74*b*. The first face 74*a* of the high-speed driven gear 74 is planar with the exception of a plurality of spaced apart cogs 108 which extend outward therefrom such that spaces 110 are formed between adjacent cogs 108. The high-speed driven gear 74 is mounted on the third section 96 of the output shaft 62 by a bearing (not shown) mounted in the passageway 74*d*. The face 74*a* of the high-speed driven gear 74 faces the face 70*b* of the medium speed driven gear 70. The cogs 108 extend in the direction of the intermediate section 94 of the output shaft 62 and may overlap the intermediate section 94. The teeth 74*c* of the high-speed driven gear 74 always intermesh with the teeth 72*c* of the high-speed pinion gear 72. When the output shaft 62 is driven by the high-speed driven gear 74 as described herein, the output shaft 62 is driven at a high-speed which is faster than the medium speed.

The shifting assembly 76 includes a dog clutch 112 mounted on the intermediate section 94 of the output shaft 62, a shaft 114 fixedly mounted between the walls 38, 42, a cam follower 116 rotatably mounted on the dog clutch 112 and rotatably mounted on the shaft 114 by a bearing 118, and a cam shaft 120 coupled to the output shaft of the shift motor 56 and to the cam follower 116. The shaft 114 is parallel to the pinion gear shaft 60 and to the output shaft 62.

Figure 11:
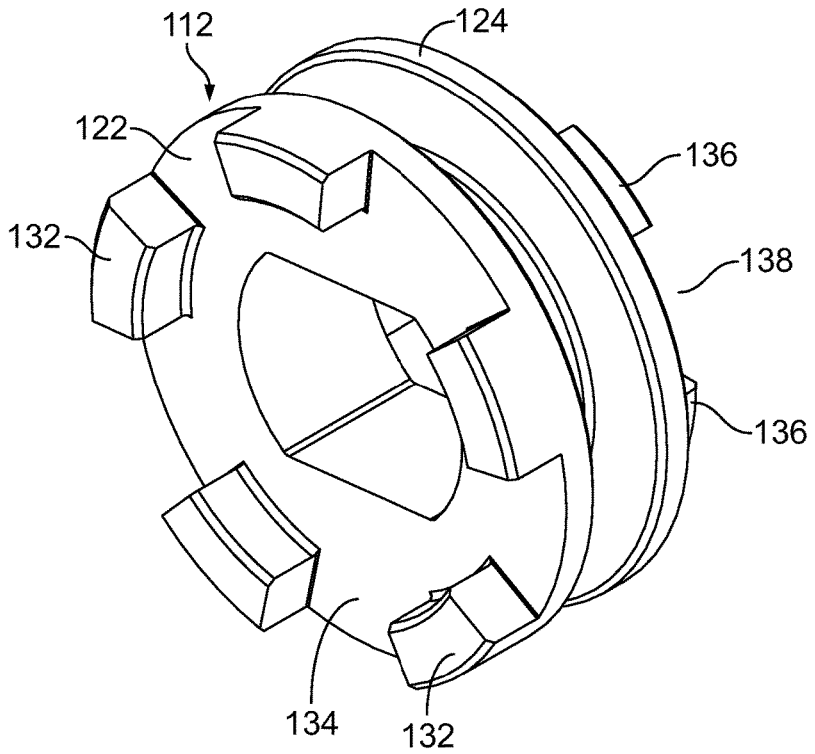
FIG. 11 depicts a perspective view of a dog clutch of the transmission.
Figure 12:
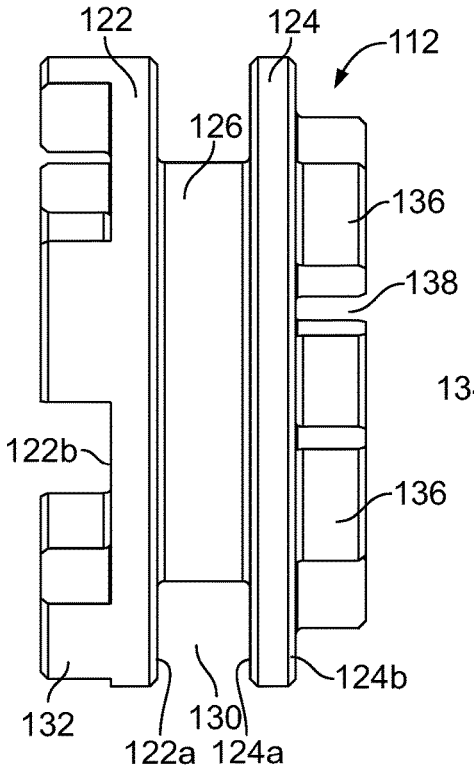
FIG. 12 depicts a side elevation view of the dog clutch.
Figure 13:
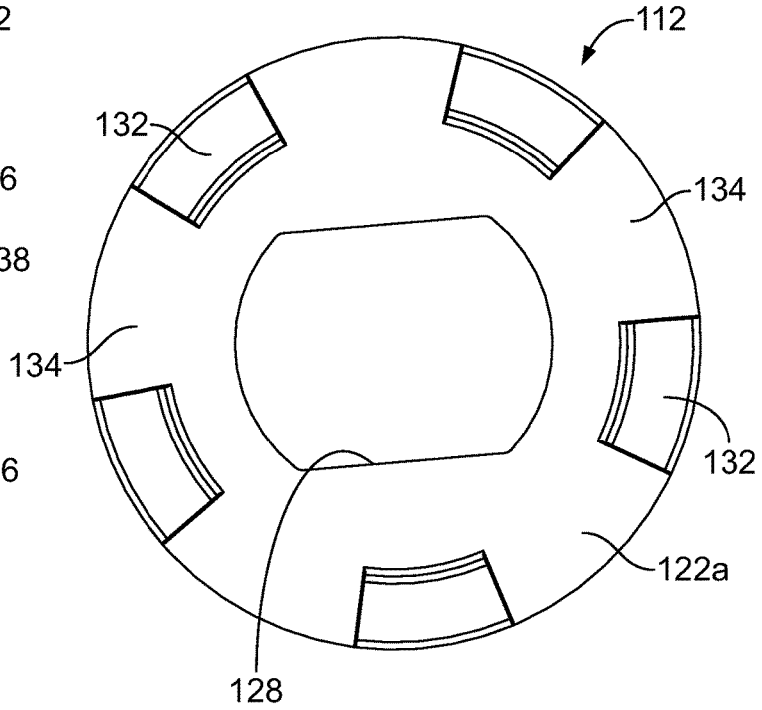
FIG. 13 depicts an end elevation view of the dog clutch.

As best shown in FIGS. 11-13, the dog clutch 112 includes first and second circular flanges 122, 124 connected together by a cylindrical body 126 extending therebetween. Each circular flange 122, 124 has an inner face 122*a*, 124*a* which face each other and an opposite outer face 122*b*, 124*b*. A central passageway 128 extends through the flanges 122, 124 and the body 126 and has ends at the outer faces 122*b*, 124*b* of the flanges 122, 124. The passageway 128 has a configuration that mirrors the shape of the non-cylindrical configuration of the intermediate section 94 of the output shaft 62. As shown, the passageway 128 has a double-D configuration. The body 126 has a diameter which is less than the diameters of the first and second flanges 122, 124 such that a groove 130 is formed around the circumference of the body 126.

The outer face 122*b* of the first flange 122 is planar with the exception of a plurality of spaced apart cogs 132 which extend outward therefrom such that spaces 134 are formed between adjacent cogs 132. The outer face 124*b* of the second flange 124 is planar with the exception of a plurality of spaced apart cogs 136 which extend outward therefrom such that spaces 138 are formed between adjacent cogs 136. The dog clutch 112 is mounted on the intermediate section 94 of the output shaft 62 such that the intermediate section 94 of the output shaft 62 passes through the passageway 128. As a result of the non-cylindrical configurations of the passageway 128 and the intermediate section 94, the dog clutch 112 can linearly translate along the intermediate section 94, but cannot rotate around the intermediate section 94. The cogs 132 on the dog clutch 112 face the cogs 104 on the medium speed driven gear 70. The cogs 136 on the dog clutch 112 face the cogs 108 on the high-speed driven gear 74.

Figure 14:
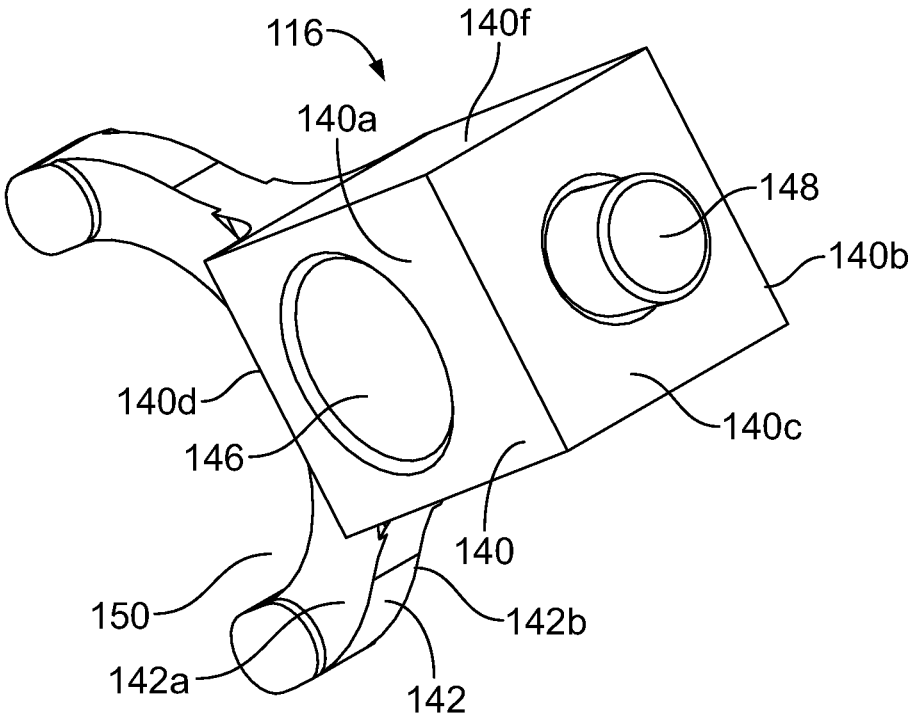
FIG. 14 depicts a perspective view of a cam follower of the transmission.
Figure 15:
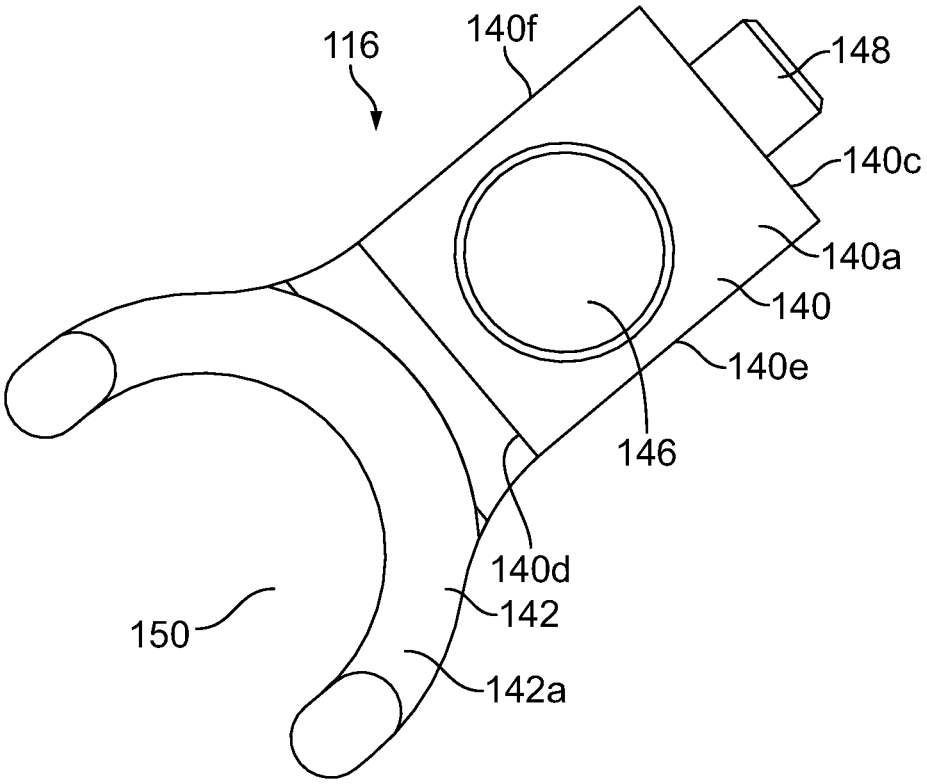
FIG. 15 depicts a side elevation view of the cam follower.
Figure 16:
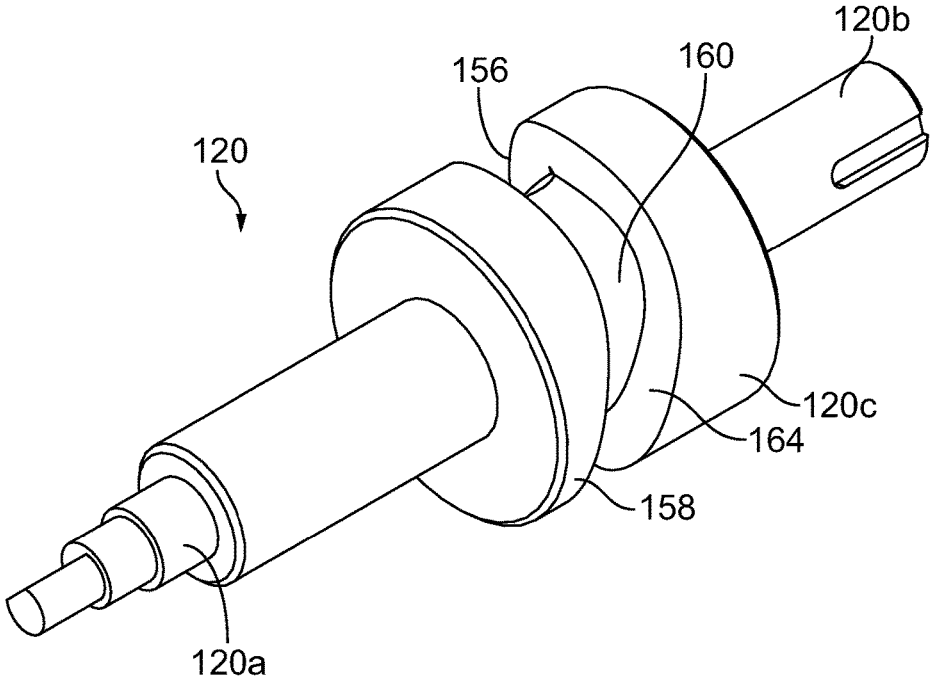
FIG. 16 depicts a perspective view of a cam shaft of the transmission.
Figure 17:
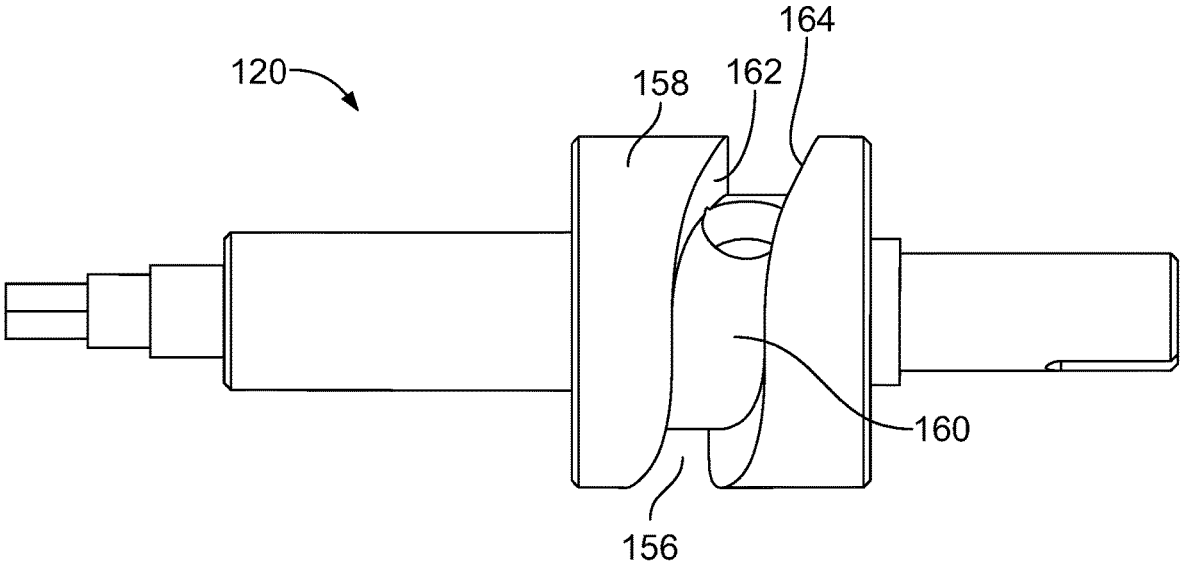
FIG. 17-20 depict side elevation views of the cam shaft in various rotational positions.
Figure 18:
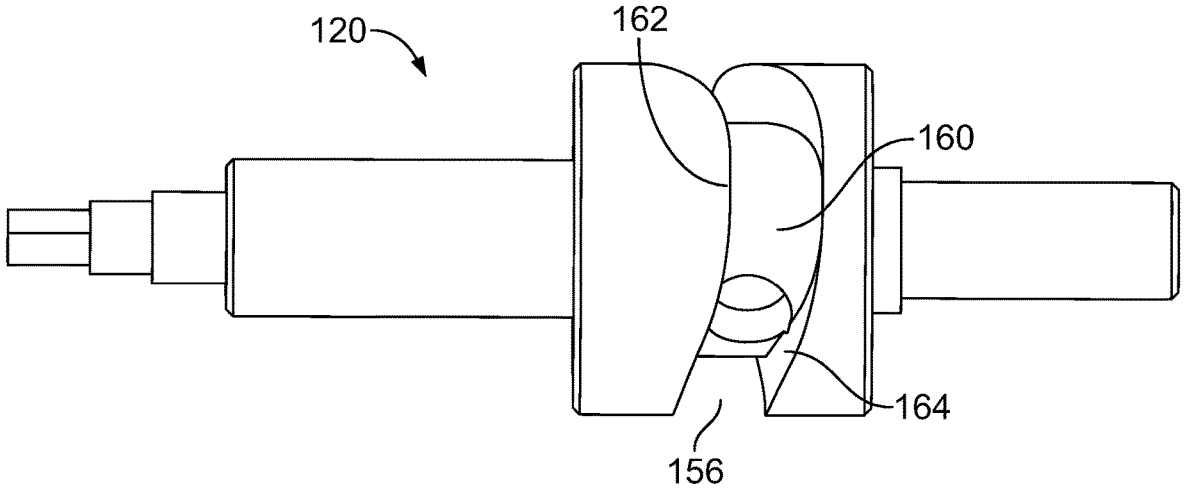
Figure 19:
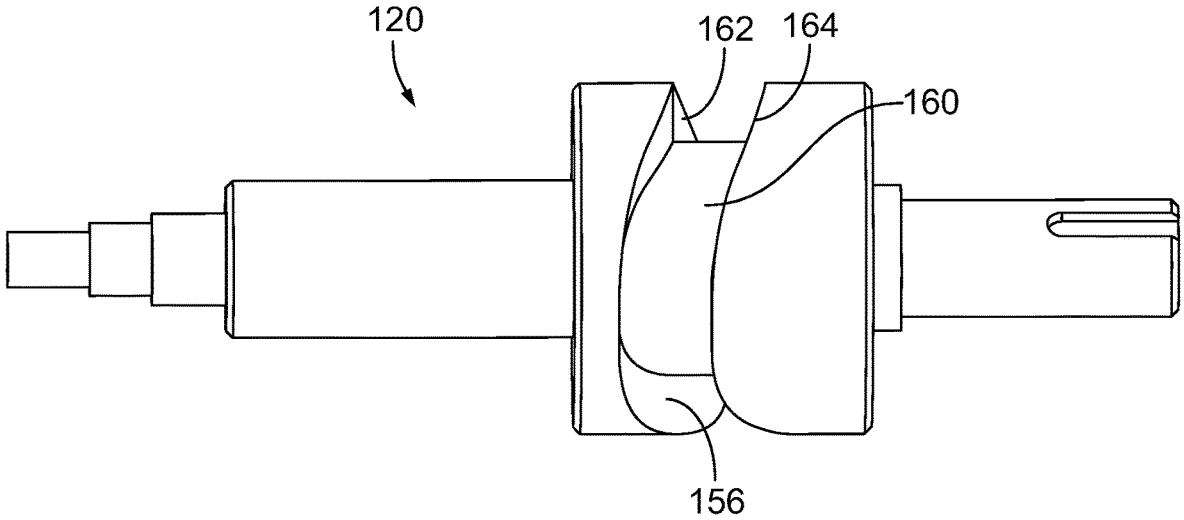
Figure 20:
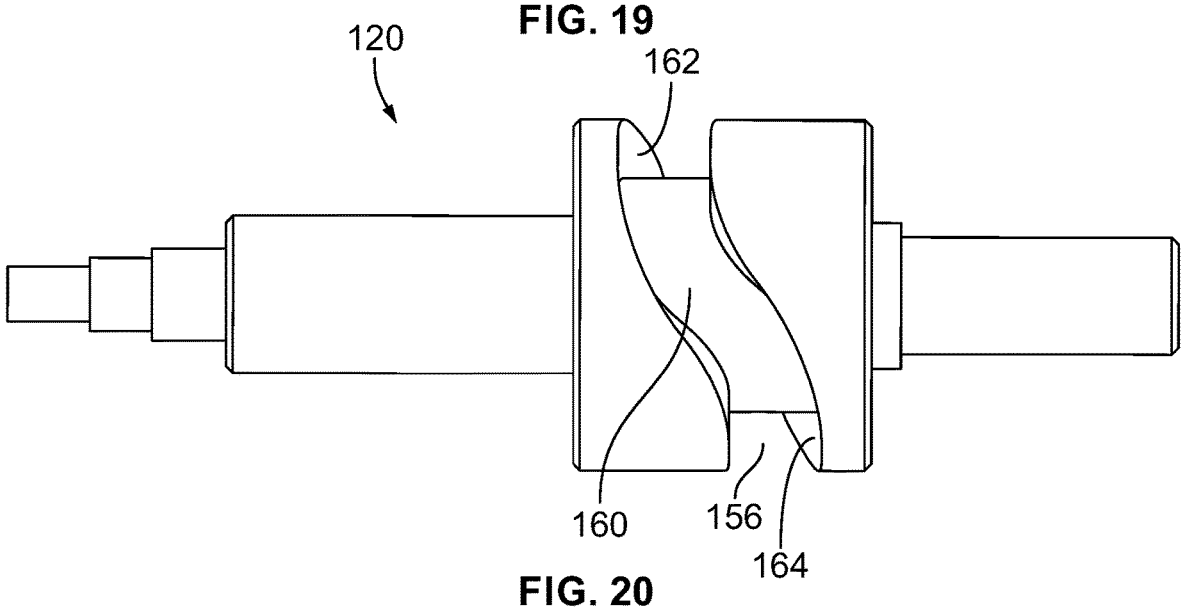

As best shown in FIGS. 14 and 15, the cam follower 116 includes a shaft mounting section 140 and a dog clutch mounting section 142 extending therefrom. The shaft mounting section 140 has a first face 140*a*, an opposite second face 140*b*, faces 140*c*, 140*d* which are opposed to each other and extend between the faces 140*a*, 140*b*, and faces 140*e*, 140*g* which are opposed to each other and extend between the faces 140*a*, 140*b*. A linear passageway 146 extends between the faces 140*a*, 140*b*. A projection 148 extends outwardly from the face 140*c* and in a direction which is transverse to the passageway 146. The dog clutch mounting section 142 extends from the face 140*d* and has a first face 142*a*, an opposite second face 142*b*, and an open-ended passageway 150 extending therebetween. The passageway 150 has a shape that mirrors the exterior shape of the body 126, and a centerline of the passageway 150 is parallel to a centerline of the passageway 146 through the shaft mounting section 140. A bearing 152 is provided in the passageway 146 of the cam follower 116 and the shaft 114 extends through the bearing 152. The dog clutch mounting section 142 seats within the groove 130 of the dog clutch 112, with the cylindrical body 126 of the dog clutch 112 seating within the passageway 150 of the cam follower 116. The first face 142*a* of the dog clutch mounting section 142 abuts against the inner face 122*a* of the first flange 122 and the second face 142*a* of the dog clutch mounting section 142 abuts against the inner face 124*a* of the second flange 124. The cam follower 116 can move relative to the dog clutch 112, but is restrained from linearly moving relative to the dog clutch 112. The cam follower 116 can rotate relative to the shaft 114 and can move linearly relative to the shaft 114, which causes the dog clutch 112 to move linearly along the intermediate section 94 of the output shaft 62.

As best shown in FIGS. 16-20, the cam shaft 120 has a first end 120*a* which rotationally attached to the wall 38 by a bearing 154 and a second opposite end which is rotationally fixed to the output shaft of the shift motor 56. A pathway 156 is formed in the cam shaft 120 and extends around the circumference thereof and extends inwardly from an exterior surface 120*c* thereof. The pathway 156 may be formed in an enlarged barrel section 158 of the cam shaft 120. The pathway 156 has a cylindrical base wall 160, a first side wall 162 extending from an end of the base wall 160 to the exterior surface 120*c* and a second side wall 164 extending from the opposite end of the base wall 160 to the exterior surface 120*c*. Each side wall 162, 164 is from a plurality of curved surfaces which form co-acting cam surfaces.

The projection 148 on the cam follower 116 seats within the pathway 156 formed in the cam shaft 120. When the projection 148 is in a first position along the pathway 156, the dog clutch 112 is positioned in a neutral position between the medium speed driven gear 70 and the high-speed driven gear 74 such that the cogs 132, 136 on the dog clutch 112 are not engaged with the cogs 104 on the medium speed driven gear 70 and are not engaged with the cogs 108 on the high-speed driven gear 74. When the projection 148 is in a second position along the pathway 156, the cogs 132 on the dog clutch 112 move into the spaces 106 on the medium speed driven gear 70 and engage with the cogs 104 on the medium speed driven gear 70. When the projection 148 is in a third position along the pathway 156, the cogs 136 on the dog clutch 112 move into the spaces 110 on the high-speed driven gear 74 and engage with the cogs 108 on the high-speed driven gear 74. The first, second and third positions at which the projection 148 can be positioned along the pathway 156 may be 120 degrees apart from each other.

Initially, the dog clutch 112 is positioned in the neutral position such that the capstan 24 is driven at a low speed. When the main motor 52 is actuated, the main motor output shaft 54 rotates which, in turn, causes rotation of the pinion gears 64, 68, 72 and the pinion gear shaft 60. Since the low speed pinion gear 64 and the low speed driven gear 66 are always intermeshed, the medium speed pinion gear 68 and the medium speed driven gear 70 are always intermeshed, and the high-speed pinion gear 72 and the high-speed driven gear 74 are always intermeshed, rotation of the pinion gears 64, 68, 72 always causes rotation of all of the driven gears 66, 70, 74. The low speed driven gear 66 is rotated when the dog clutch 112 is in the neutral position, which causes rotation of the output shaft 62 via the overrunning clutch 102 in the same direction as the main motor output shaft 54. The medium speed driven gear 70 and the high-speed driven gear 74 rotate around the output shaft 62 via their bearings.

When the operator desires to shift the cable puller 20 to run the capstan 24 at a medium speed, the control apparatus 200 (FIG. 21) instructs activation of the shift motor 56 to rotate in a first direction. This causes the cam shaft 120 to rotate in the first direction and causes the projection 148 of the cam follower 116 to travel along the pathway 156. This, in turn, causes the dog clutch 112 to move linearly along the shaft 114 and the intermediate section 94 of the output shaft 62 and toward medium speed driven gear 70. Upon further movement, the cogs 132 on the dog clutch 112 move into the spaces 106 on the medium speed driven gear 70 and engage with the cogs 104 on the medium speed driven gear 70. This rotationally fixes the medium speed driven gear 70 to the output shaft 62. The shift motor 56 is activated until the projection 148 is positioned at a predetermined position along the pathway 156. This action can be taken without stopping the main motor 52. Once the medium speed driven gear 70 is rotationally fixed to the output shaft 62, this causes rotation of the output shaft 62 at the medium speed. Since the output shaft 62 is rotating at a speed which is faster than the speed at which the low speed driven gear 66 rotates, this cause the overrunning clutch 102 to be overrun and to mechanically disconnect the low speed driven gear 66 from the output shaft 62.

When the operator desires to shift the cable puller 20 to run the capstan 24 at a high-speed, the control apparatus 200 (FIG. 21) instructs activation of the shift motor in the first direction. This causes the cam shaft 120 to rotate in the first direction. The shape of the pathway 156 causes the projection 148 of the cam follower 116 to travel along the pathway 156 in the same direction. The projection 148 of the cam follower 116 travels along the pathway 156, which causes the dog clutch 112 to move linearly along the shaft 114 and the intermediate section 94 of the output shaft 62 and away from medium speed driven gear 70. The dog clutch 112 moves toward the high-speed driven gear 74 and past the neutral position as the projection 148 travels along the pathway 156. Upon further movement, the cogs 136 on the dog clutch 112 move into the spaces 110 on the high-speed driven gear 74 and engage with the cogs 108 on the high-speed driven gear 74. This rotationally fixes the high-speed driven gear 74 to the output shaft 62. This action can be taken without stopping the main motor 52. Once the high-speed driven gear 74 is rotationally fixed to the output shaft 62, this causes rotation of the output shaft 62 at the high-speed. Since the output shaft 62 is rotating at a speed which is faster than the speed at which the low speed driven gear 66 rotates, this cause the overrunning clutch 102 to be overrun and to mechanically disconnect the low speed driven gear 66 from the output shaft 62.

When the operator desires to shift the cable puller 20 to run the capstan 24 at a low or medium speed while running at a high speed, the control apparatus 200 (FIG. 21) instructs activation of the shift motor in a second direction. This causes the cam shaft 120 to rotate in the second direction. The shape of the pathway 156 causes the projection 148 of the cam follower 116 to travel along the pathway 156 in the opposite direction. The projection 148 of the cam follower 116 travels along the pathway 156, which causes the dog clutch 112 to move linearly along the shaft 114 and the intermediate section 94 of the output shaft 62 and away from high speed driven gear 74. The dog clutch 112 moves toward the medium-speed driven gear 70.

If the instruction from the control apparatus 200 was to run in the low speed from the high speed, the shift motor is stopped with the dog clutch 112 in the neutral position to drive the capstan in the low speed. If the instruction was to run in the medium speed from the high speed, the dog clutch 112 moves past the neutral position as the projection 148 travels along the pathway 156. Upon further movement, the cogs 132 on the dog clutch 112 move into the spaces 106 on the medium-speed driven gear 70 and engage with the cogs 104 on the medium-speed driven gear 70. This rotationally fixes the medium-speed driven gear 70 to the output shaft 62.

The specific orientations of the gears can be modified as would be understood by one skilled in the art such that the specific layout (that is, the low speed gears being forward of the medium speed gears and the medium speed gears being forward of the high-speed gears) can be modified to perform the same functionality.

Figure 21:
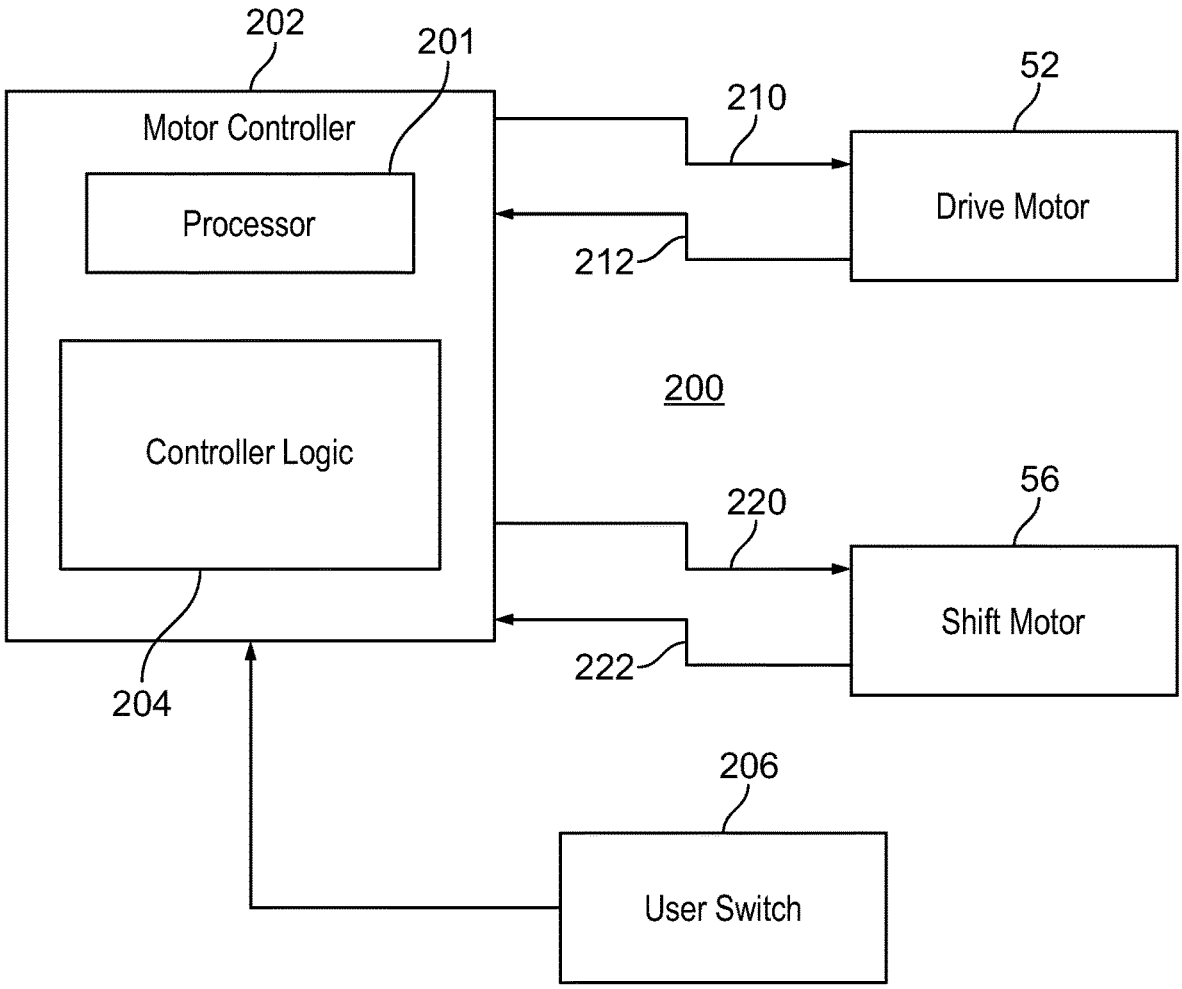
FIG. 21 is a block diagram of a control system for controlling operation of the cable puller.

FIG. 21 is a block diagram of a control apparatus 200 for controlling operation of the cable puller. The control apparatus 200 includes a motor controller 202, the drive motor 52, the shift motor 56, and a user switch 206. The drive motor 52 and shift motor 56 are described above. The drive motor 52 may be actuated using a drive signal 210 or signals that can be controlled to adjust the speed of the motor. In one example implementation, the duty cycle of the signal may be indicative of the motor speed. One or more feedback signals 212 may be received from the drive motor 52 to indicate a power level at which the drive motor is operating. In one example implementation, the power level may be indicated by the measurement of certain electrical signals from the drive motor 52. For example, the motor controller 202 knows the voltage of the drive signal 210 and can measure a current level from the drive motor 52 to determine a power level using P=V*I.

A shift motor drive signal 220 may be used to drive the shift motor 56. While the drive motor 52 may be driven continuously for periods of time required to pull the cable, the shift motor 56 may be driven sufficient to shift from gear position to gear position. The shift motor drive signal 220 may be configured to drive the motor in a certain direction to move the cam shaft 120 to the desired gear position. A gear position feedback signal 222 may be received to monitor the gear position during the motion of the shift motor 56. The shift motor may then be stopped when the gear position indicative of a target gear position is reached.

In an example implementation, the gear position feedback signal 222 may be a digital output of an analog-to-digital (ADC) converter connected to an analog encoding device. The analog encoding device may be, for example, a potentiometer connected to, or mounted on, a shaft of the shift motor 56 to track the position of the shift motor 56. The change in the voltage across the potentiometer due to the changing resistance of the potentiometer may be associated with the change in position of the shift motor 56. The ADC digitizes the voltage across the potentiometer and provides the digital value as input to the motor controller 202. Controller logic 204 may then use the digital value to shift motor direction and duty cycle to obtain a new gear position. The duty cycle may be continuously adjusted while the shift motor 56 performs shifting based on the distance away from the new gear position and the time elapsed since initiating the shift. In an alternative embodiment, a rotary encoder or other suitable encoding device may be used instead of a potentiometer.

The user switch 206 may be any suitable switching device. In one example implementation, the user switch 206 includes a foot pedal the user may press, press and hold, and press multiple times to operate the cable puller in a desired mode. The cable puller may be used in an automatic mode in which the user may power the cable puller to drive the drive motor and to enable automatic adjustment of the gear position and motor speed based on the load placed on the drive motor by the cable being pulled. In the automatic mode, the shift motor operates as an automatic transmission that reacts to the cable load and adjusts power and speed of the drive motor, and shifts between low, medium and high gears.

The motor controller 202 includes the processor 201, which may be any suitable computing element, such as a microprocessor, a microcomputer, or the like. The selected processor 201 should have a suitable speed, bus size, and form factor for operation in a power tool such as the cable puller.

Figure 22:
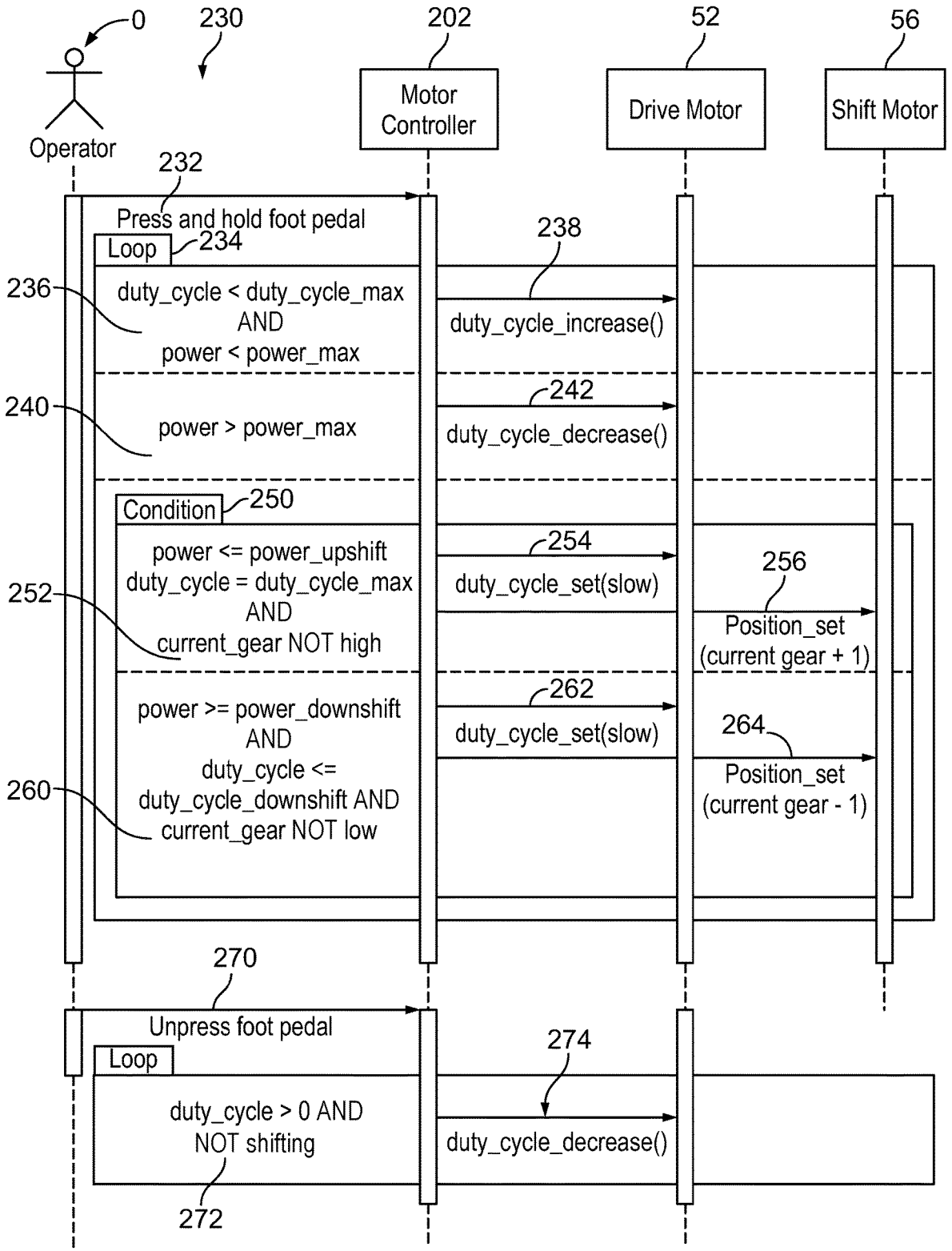
FIGS. 22 and 23 are control flow diagrams illustrating operation of example methods for controlling the drive motor and shift motor to drive the cable puller.
Figure 23:
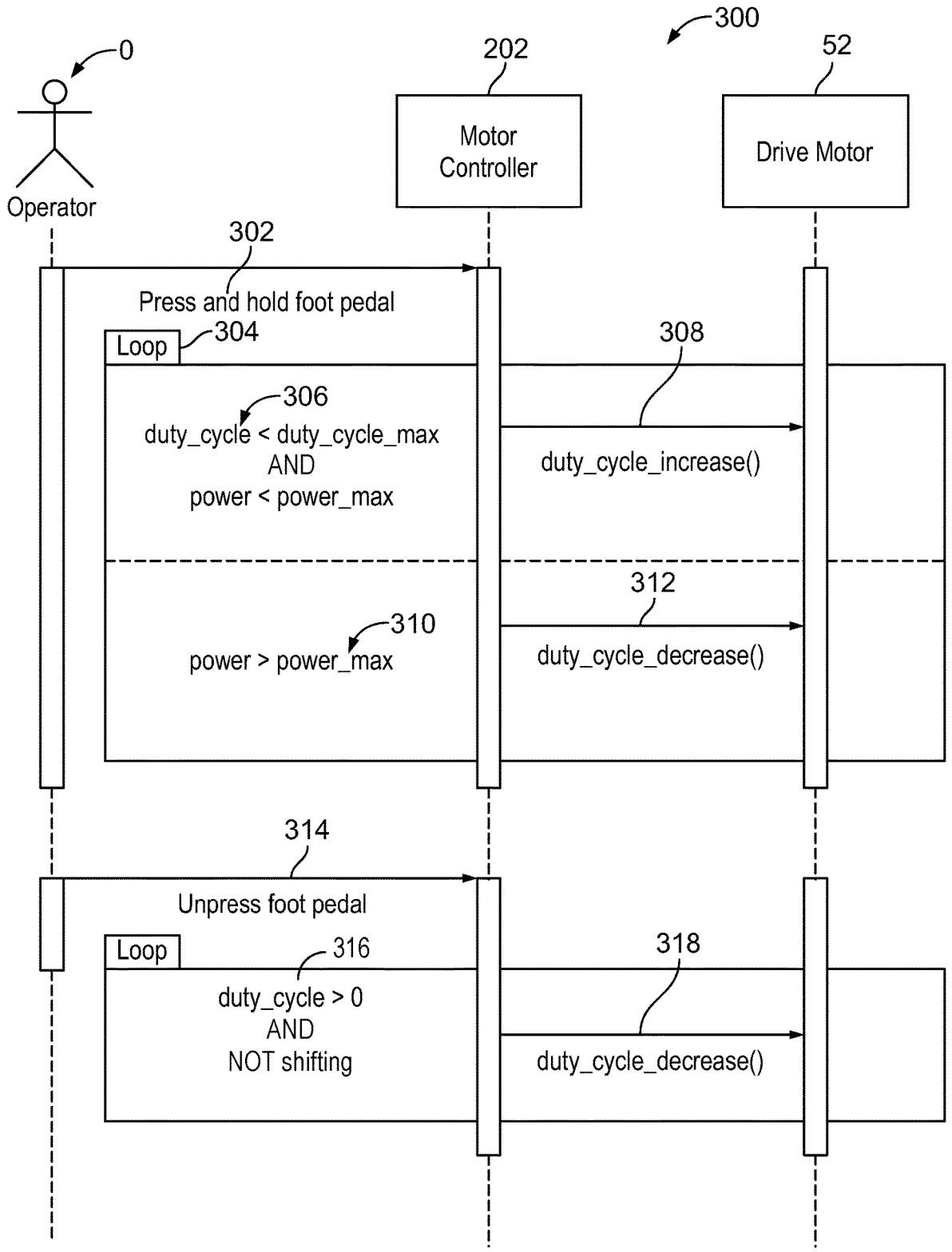
Figure 24:
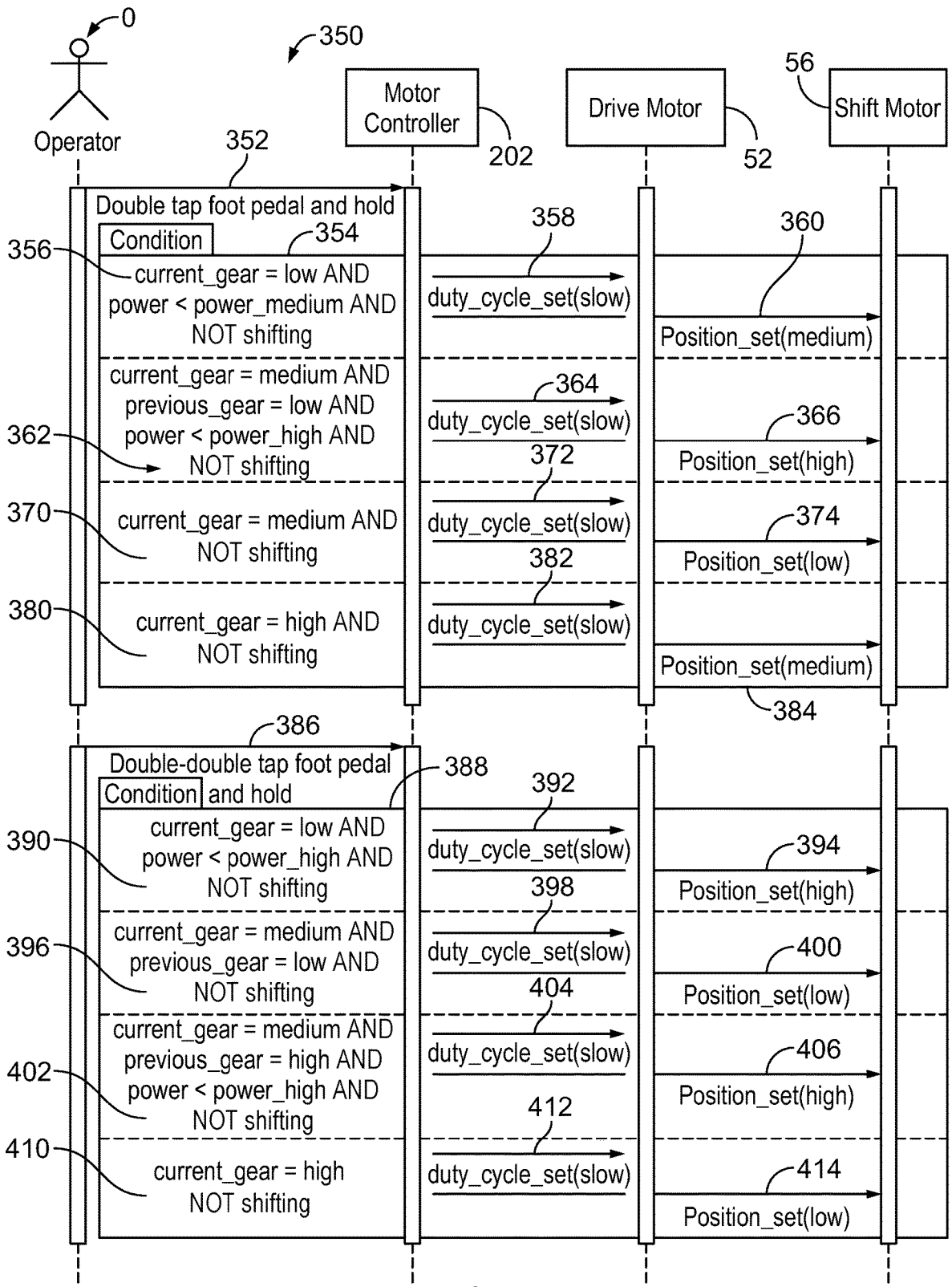
FIG. 24 is a schematic diagram of a user interface configured to provide user control of an example implementation of a cable puller.
Figure 25:
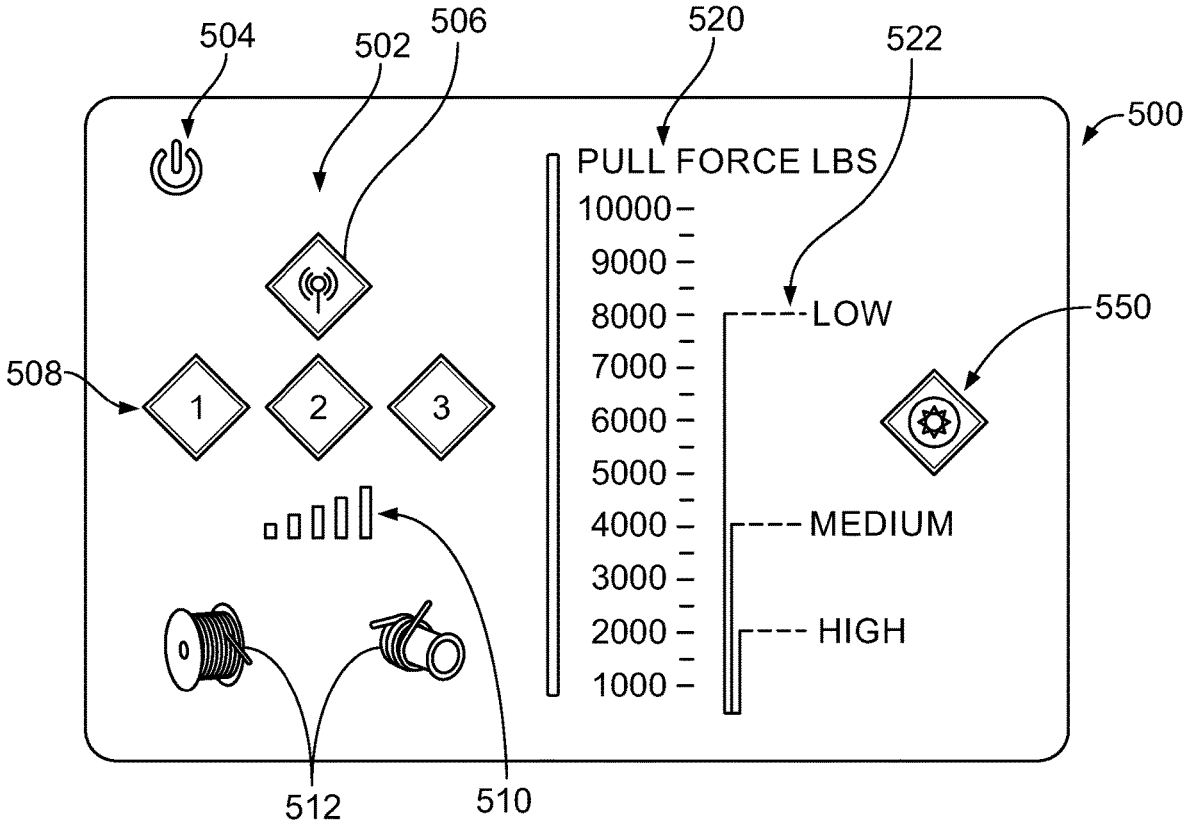
FIG. 25 is an example user interface.

The motor controller 202 includes memory sufficient to store controller logic programmed to execute the functions used by the cable puller. FIGS. 22-24 are control flow diagrams illustrating operation of example methods for controlling the drive motor 52 and shift motor 56 to drive the cable puller. FIG. 22 illustrates operation in an automatic mode. FIG. 23 illustrates operation of the drive motor in a manual mode. FIG. 24 illustrates operation of the shift motor 56 in a manual mode. In example implementations, a mechanism may be included to allow the user to switch between the manual mode and the automatic mode. FIG. 25 is a schematic representation of an example of a user interface for a cable puller that includes a mode switch.

Referring to FIG. 22, an operator O operates the user switch 206 (FIG. 21), which in the illustrated example is a foot pedal by pressing the foot pedal and holding it in a depressed state at 232. The actuation of the foot pedal is sensed by the motor controller 202 as indicated by 232. The motor controller 202 turns the drive motor 52 on if, at 236, the current drive motor speed is less than a maximum speed and a current power level is less than the maximum power specified for operation. The motor controller 202 may determine the speed by the drive signal used to drive the drive motor 52. The drive signal is provided to the drive motor 52 at 238 as indicated by a duty_cycle_increase( ) command at 238.

At 240, the drive motor is being driven and the power level at which the drive motor operates is continuously monitored. If the power level rises above the maximum power level specified for operation, the drive motor is driven at a lower speed at 242. In the illustrated example, duty cycle of the signal at 242 is decreased to slow the drive motor.

It is noted that three gear positions are available by the shift motor 56. In general, the low speed gear position is used when the load on the cable puller is higher and more torque is required to pull the cable. As the load is lessened, less torque is needed to pull the cable and the drive motor may be operated at a higher speed. The shift motor may be used to shift to the medium speed gear position. If even less torque is needed, the drive motor speed may be increased by setting the shift motor to the high-speed gear position.

At 250, the power level, motor speed, and current gear positions are monitored continuously, and the drive motor and shift motor are controlled accordingly. At 252, if the power level is less than or at a level at which the gear position of the shift motor may be shifted up (to medium or high), and the drive motor speed is at a predetermined maximum speed, and the current gear position of the shift motor is not at the high-speed gear position, the motor speed is set to a slow motor speed at 254, and the shift motor is shifted up one gear level at 256. At 260, if the power level is greater than or at a level at which the gear position of the shift motor may be shifted down (to medium or low), and the drive motor speed is less than or equal to a predetermined downshift speed, and the current gear position of the shift motor is not at the low speed gear position, the motor speed is set to a slow motor speed at 262, and the shift motor is shifted down one gear level at 264.

The automatic mode advantageously maintains efficient operation of the cable puller by adjusting both the motor speed and the gear positions such that the right amount of power is expended at a sufficiently high-speed to pull the cable with a minimum of stoppage, or no stoppage of the motor at all. Once the operator O releases the foot pedal, the motor speed is checked. If the motor speed is greater than zero at 272, the motor speed of the drive motor is decreased at 274. In addition, the cable puller starts pulling at a high speed and reduces the speed based on the load on the motor. The cable puller maintains the highest speed possible providing another advantage over known cable pullers, which typically start pulling at low speeds and increase the speed as the pull progresses.

Referring to FIG. 23, control flow diagram 300 illustrates operation in the manual mode. FIG. 23 illustrates operation of the drive motor 52 as controlled by the motor controller 202. Operation of the shift motor in the manual mode is illustrated in FIG. 24.

At 302, the operator O presses and holds down the foot pedal at 302. At 304, a process of monitoring speed and power is started, and adjustments to motor speed are carried out in response. At 306, if the motor speed (determined by a drive signal where the motor speed corresponds to the duty cycle of the drive signal) is less than the maximum drive motor speed and the current power level is less than the maximum specified power level, the motor speed is increased at 308. At 310, if the power increases to exceed the maximum specified power level, the motor speed is decreased at 312.

At 314, the operator O releases the foot pedal, which is sensed by the motor controller 202. At 316, if the motor speed is greater than zero and the cable puller is not shifting to a different gear, the motor speed is decreased at 318.

Referring to FIG. 24, the motor controller 202 may control the shift motor 56 in a manual mode as illustrated by control flow diagram 350. At 352, the operator O may indicate to the motor controller 202 to enable shifting to different gears during manual mode operation with a double tap of the foot pedal. In an example implementation, the user holds the foot pedal down to keep the drive motor running and allow a shift gear position change to occur. In such implementations, if the user releases the foot pedal after the double tap, the drive motor winds down to a complete stop, if it was in operation, and the shift gear position would not change in the controller logic. The shift gear position change would occur when the foot pedal is depressed and held down as described below.

At 356, if the current gear is the low speed gear position after the double tap, and the power level is less than a predetermined medium power level, the drive motor is driven at a reduced speed at 358 and the shift motor is driven to shift to the medium speed gear position at 360. At 362, if the current gear is set to the medium speed gear position, and the previous gear position was the low speed gear position, and the power level is less than a predetermined high power level, the drive motor is driven to travel at a reduced speed at 364. The shift motor 56 is controlled to shift to the high-speed gear position at 366. At 370, if the current gear position of the shift motor is the medium speed gear position and the shift motor is not shifting, the motor speed of the drive motor is set to the reduced speed at 372. The shift motor is controlled to shift to the low speed gear position at 374. At 380, if the current gear is the high-speed gear position, the drive motor is set to operate at a reduced speed at 382. The shift motor is controlled to shift to the medium speed gear position at 384.

During operation of the control flow started at 352 in FIG. 24 the cable puller is pulling the cable at a suitable speed with a suitable power level. At 386, the operator O may double-tap the foot pedal twice (four taps) to shift gears non-sequentially. In example implementations, the operator may hold the foot pedal to keep the drive motor running through the gear position change. If the foot pedal is not held after the double-double foot tap, the drive motor may wind down to a stop without a change in gear position in the controller logic. Depressing and holding the foot pedal would start the drive motor and effect the gear shift position as described below. It is noted that the foot pedal may be timed to distinguish the double tap at 352 to shift up or down sequentially, and the double-double tap at 386 to shift up or down by skipping gears.

The motor controller 202 senses the double-double tap and checks the gear position, power level and motor speed at 388. At 390, if the current gear is the low speed gear position and the power level is at a predetermined high-power level, the drive motor is set to operate at a reduced speed at 392. The shift motor 56 is controlled to shift to the high-speed gear position at 394. At 396, if the current gear is at the medium speed gear position, and the previous gear was the low gear, the drive motor speed is set to the reduced speed at 398. The shift motor is controlled to shift to the low speed gear position at 400. At 402, if the current gear is the medium speed gear position and the previous gear was the high-speed gear position and the power level is less than the predetermined high power level, the drive motor speed is set to the reduced speed at 404. The shift motor is controlled to shift up to the high-speed gear position at 406. At 410, if the current gear is the high-speed gear position, the motor speed of the drive motor is set to a reduced speed at 412 and the shift motor 414 is set controlled to shift to the low speed gear position.

It is noted that the motor speed may be controlled and determined by adjusting and noting the duty cycle of the drive signal used to drive the drive motor 52. In other implementations, a different drive signal may be used, or a different parameter is used to adjust and determine the motor speed. Different motors may require the use of different drive signals. In addition, the power upshift level, power downshift level, power medium, power low, and power high power levels may be identified through testing according to desired performance specifications.

The descriptions above with reference to FIGS. 22-24 illustrate operation of an example cable puller in the automatic and manual modes. The cable puller may be set to operate in a default mode, which may be manual or automatic. An example implementation may include user control of the operating mode. FIG. 25 is a schematic diagram of an example user interface 500 that may be implemented in an example implementation of the cable puller. The user interface 500 in FIG. 25 includes a power indicator 504 to indicate whether power to the cable puller is on or off, and a wireless mode panel 502 to allow the cable puller to communicate wirelessly with a cable feeder.

The wireless mode panel 502 includes a wireless module selector 506, a plurality of channel selector switches 508, a signal strength indicator 510, and indicators 512 to display an identification of whether the cable puller or cable feeder are communicating. The user interface 500 may also include a force scale 520 indicating a pull force of the cable puller, and a plurality of current gear position indicators 522. A mode switch 550 provides the user with control over the mode (automatic or manual) in which the cable puller is to operate. As noted above, the cable puller may operate, for example, in a default mode. The operator may switch the cable puller out of the default mode using the mode switch 550. The mode switch 550 may be implemented in an assembly with indicator LEDs to indicate whether the puller is in an automatic mode or a manual mode. In one implementation, an LED of a first color indicates the puller is in the manual mode and an LED of a second color indicates the puller is in the automatic mode.

It is noted that if the cable puller operates in a wireless communication mode with a cable feeder, the cable puller operation is not affected, in general. In example implementations, the cable puller drive motor may not be enabled for operation if the user switch (e.g., foot switch) for the cable feeder is not actuated (e.g., depressed foot switch).

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

What is claimed is:

1. A cable puller configured to pull rope or cable comprising:

a puller frame;

a capstan rotatably mounted on the puller frame around a first axis of rotation;

an output shaft rotatably mounted to the puller frame and coupled to the capstan, wherein the capstan rotates when the output shaft is driven;

a main motor configured to rotate the output shaft via gearing, wherein the gearing comprises a pinion shaft rotatably mounted to the puller frame, a low speed pinion gear on the pinion shaft, the low speed gear being coupled to the main motor, a low speed driven gear mounted on the output shaft by an overrunning clutch, the low speed driven gear being intermeshed with the low speed pinion gear, a medium speed pinion gear on the pinion shaft, a medium speed driven gear mounted on the output shaft by a bearing, the medium speed driven gear being intermeshed with the medium speed pinion gear, a high-speed pinion gear on the pinion shaft, a high-speed driven gear mounted on the output shaft by a bearing, the high-speed driven gear being intermeshed with the high-speed pinion gear; and a shift motor configured to be coupled to one of medium speed driven gear and to the high-speed driven gear.

2. The cable puller of claim 1, further comprising a cam shaft coupled to the shift motor and configured to be rotated by the shift motor, the cam shaft having a pathway therein forming a cam surface;

a dog clutch mounted on the output shaft between the medium driven gear and the high-speed driven gear, the dog clutch being mounted for linear movement on the output shaft but being restrained from rotational movement on the output shaft; and a cam follower coupled to the dog clutch and engaged with the cam surface, and wherein rotation of the cam shaft by the shift motor causes the dog clutch to engage with one of the medium driven gear and the high-speed driven gear.

3. The cable puller of claim 2, wherein the dog clutch has a plurality of cogs extending from a first surface thereof and a plurality cogs extending from a second surface thereof;

the medium speed driven gear has a plurality cogs extending from a surface thereof which faces the first surface of the dog clutch, the cogs of the medium speed driven gear being engageable with the cogs on the first surface of the dog clutch; and the high-speed driven gear has a plurality cogs extending from a surface thereof which faces the second surface of the dog clutch, the cogs of the high-speed driven gear being engageable with the cogs on the second surface of the dog clutch.

4. The cable puller of claim 2, wherein the output shaft has a non-cylindrical section between the medium driven gear and the high-speed driven gear, wherein the dog clutch is mounted on the non-cylindrical section by a non-cylindrical passageway provided through the dog clutch.

5. The cable puller of claim 4, wherein the non-cylindrical section is formed from a double-D shape.

6. The cable puller of claim 2, wherein the pinion shaft, the output shaft and the cam shaft are parallel to each other.

7. The cable puller of claim 2, wherein the overrunning clutch is one of a sprag clutch, a roller ramp clutch, a wrap spring clutch, and a wedge clutch.

8. The cable puller of claim 1, wherein the pinion shaft and the output shaft are parallel to each other.

9. The cable puller of claim 1, wherein the main motor and the low speed pinion gear are coupled together by at least one idler roller.

10. The cable puller of claim 1, wherein the overrunning clutch is one of a sprag clutch, a roller ramp clutch, a wrap spring clutch, and a wedge clutch.

11. The cable puller of claim 1, wherein the gearing further comprises a planetary gear set coupled to the output shaft and coupled to the capstan.

12. The cable puller of claim 1, wherein the main motor is one of a servomotor and stepper motor.

13. The cable puller of claim 1, wherein the shift motor is one of a servomotor and stepper motor.

14. The cable puller of claim 1, wherein the shift motor is a rotary solenoid.

15. The cable puller of claim 1, further comprising a boom mounted to the puller frame.

16. The combination of claim 15, further comprising a conduit engaging assembly mounted to the boom.

* * * * *